US006570481B2

(12) United States Patent
Katsube et al.

(10) Patent No.: US 6,570,481 B2
(45) Date of Patent: May 27, 2003

(54) CIRCUIT BREAKER

(75) Inventors: Shunichi Katsube, Tokyo (JP); Kazunori Fukuya, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/980,590

(22) PCT Filed: Feb. 22, 2001

(86) PCT No.: PCT/JP01/01301

§ 371 (c)(1),
(2), (4) Date: Dec. 4, 2001

(87) PCT Pub. No.: WO01/80269

PCT Pub. Date: Oct. 25, 2001

(65) Prior Publication Data

US 2003/0048169 A1 Mar. 13, 2003

(30) Foreign Application Priority Data

Apr. 14, 2000 (WO) ..... PCT/JP00/02461

(51) Int. Cl.[7] ..... H01H 73/52; H01H 73/06; H01H 33/04; H01H 9/30

(52) U.S. Cl. ..... 337/112; 337/97; 337/59; 337/37; 335/23; 335/35; 218/158

(58) Field of Search ..... 337/3, 36, 37, 337/38, 58, 59, 97, 112; 335/23, 31, 35, 141; 218/34, 158; 428/920, 921

(56) References Cited

U.S. PATENT DOCUMENTS

| | | | | | |
|---|---|---|---|---|---|
| 3,786,041 | A | * | 1/1974 | Talsma | 524/35 |
| 3,912,671 | A | * | 10/1975 | Kondo et al. | 524/436 |
| 4,533,687 | A | * | 8/1985 | Itoh et al. | 524/80 |
| 4,668,718 | A | * | 5/1987 | Schreiber | 523/451 |
| 4,939,195 | A | * | 7/1990 | Ishino et al. | 524/185 |
| 4,950,852 | A | * | 8/1990 | Goldman et al. | 218/150 |
| 4,975,551 | A | * | 12/1990 | Syvertson | 218/150 |
| 5,147,918 | A | * | 9/1992 | Price | 524/442 |
| 5,166,651 | A | * | 11/1992 | Jacobs et al. | 335/202 |
| 5,216,063 | A | * | 6/1993 | Williams | 524/414 |
| 5,290,835 | A | * | 3/1994 | Hatayama et al. | 524/109 |
| 5,841,088 | A | * | 11/1998 | Yamaguchi et al. | 218/158 |
| 5,990,440 | A | * | 11/1999 | Yamaguchi et al. | 218/158 |
| 6,361,848 | B1 | * | 3/2002 | Katsube et al. | 428/70 |
| 6,414,067 | B2 | * | 7/2002 | Katsube et al. | 524/436 |

FOREIGN PATENT DOCUMENTS

| | | | | | |
|---|---|---|---|---|---|
| JP | 6-68769 | | | 3/1994 | H01H/73/06 |
| JP | 8-171831 | | | 7/1996 | H01H/9/04 |
| JP | 08171847 | A | * | 7/1996 | H01H/73/18 |
| JP | 30163448 | | | 7/1996 | |
| JP | 9-500404 | | | 1/1997 | C08L/77/00 |
| JP | 09115409 | A | * | 5/1997 | H01H/73/18 |
| JP | 09161641 | A | * | 6/1997 | H01H/73/02 |
| JP | 10-321112 | | | 12/1998 | H01H/73/06 |
| JP | 11-3648 | | | 1/1999 | H01H/73/24 |
| JP | 11-288653 | | | 10/1999 | H01H/73/06 |
| JP | 2000-67730 | | | 3/2000 | H01H/73/06 |
| JP | 2001093394 | A | * | 4/2001 | H01H/73/02 |
| JP | 2001123041 | A | * | 5/2001 | C08L/61/08 |

OTHER PUBLICATIONS

U.S. patent application Ser. No. 08/492,523, filed Jun. 20, 1995.

* cited by examiner

*Primary Examiner*—Anatoly Vortman
(74) *Attorney, Agent, or Firm*—Sughrue Mion, PLLC

(57) ABSTRACT

The invention relates to a circuit breaker having a crossbar (7) that is supported swingably onto a base (1B) to hold swingably movable contacts (4), and has the small reduction of overtravel in the elapsed years, and can reduce its size. The bending modulus of elasticity Eb, Ec of the base (1B) and the crossbar (7) at the ordinary temperature/ordinary humidity satisfy following relationships $$Eb+Ec \geqq 17000 \text{ MPa} \quad (1)$$

$$8000 \text{ MPa} \leqq Eb \quad (2)$$

$$9000 \text{ MPa} \leqq Ec \quad (3).$$

39 Claims, 11 Drawing Sheets

CIRCUIT BREAKER

TECHNICAL FIELD

The present invention relates to a circuit breaker having a base constituting a molded case employed to protect the electric cables and lines and a crossbar supported onto this base to hold a movable contact and, more particularly, a circuit breaker, for example, a molded case circuit breaker stipulated in IEC60947-2, that has a function of executing quick-make and quick-break of the movable contact by swinging the crossbar by virtue of an accumulated force of a toggle link mechanism regardless of an ON/OFF operation speed of a handle, and is excellent in the prevention of contact point deposition in the open/close operation and the concurrent closing of respective contacts.

BACKGROUND ART

As set forth in Patent Application Publication (KOKAI) Hei 09-161641, for example, the circuit breaker in the prior art comprises a molded case consisting of a base and a cover, a movable contact provided to the inside of the molded case to have a movable contact point, a fixed contact having a fixed contact point that is connected/disconnected to/from the movable contact point, a crossbar that is molded out of the insulating material and supported onto the base in the closed state of the circuit breaker to hold the movable contact swingably, a switching mechanism portion for opening/closing the movable contact via this crossbar, a spring for pushing the movable contact point against the fixed contact point in the closed state of the circuit breaker, etc.

The contact points are worn away and eroded away by the arc that is generated by the repetition of the opening/closing operations and the opening/closing in the current supply in the actual use due to the electrical and mechanical or both factors. In order to maintain the stability of contact between the contact points even when the contact points are worn away and eroded away in this manner, a predetermined overtravel is provided. Where the "overtravel" is an amount of movement of the movable contact point before and after the removal, i.e., an amount that indicates the contacting margin of the contact point when the fixed contact and the fixed contact point are removed in the closed state of the circuit breaker, and is about one to two times a thickness of the contact point.

The crossbar and the base as constituent parts of the circuit breaker, that are formed of thermosetting resin as a principal component, were employed since the mechanical strength, the thermal resistance, the insulating property, etc. are required of them. For example, as the 30 ampere-frame circuit breaker, the crossbar was molded out of the material containing phenol 52 wt %, glass fiber 15 wt %, inorganic filler 10 wt %, wood flour 15 wt %, and pigment and others 8 wt %, and the base was molded out of the material containing phenol 50 wt %, wood flour 30 wt %, inorganic filler 15 wt %, and pigment and others 5 wt %.

In the circuit breaker in the prior art, since the base that occupies most of the volume of the plastic parts is constructed by the thermosetting resin such as phenol resin, unsaturated polyester resin, etc. as a principal component, the reduction in thickness of the parts is difficult to disturb the reduction in size and the reduction in weight.

In particular, in the base constructed by the thermosetting resin as a principal component, portions constituting the base interior need a predetermined thickness or more because of the molding restriction irrespective of the size of the base. Thus, such portions constituting the base interior are formed excessively thick and thus the reduction in size of the base becomes difficult. For example, in the small circuit breaker having 225 ampere-frame or less in which the interpole pitch is less than 35 mm, the pressure of the spring between the contact points is less than 20 N, etc., the rib having a height of more than 2 mm needs the thickness of more than about 2 mm because of the molding restriction and thus the portions constituting the base interior are formed excessively thick. Here the rib thickness of 2 mm is such a value that is decided with a minute margin to satisfy the minimum thickness standard of more than 1 mm to 3 mm of the thermosetting resin, that is normally well known.

Also, since the base of the circuit breaker in the prior art contains the thermosetting resin as a principal component, the flash generated in the molding, the sprue and the runner generated in the injection molding, etc. must be destroyed by fire or buried under the ground.

Then, for the reasons that the molding precision of details can be increased, etc., it is examined to employ the moldings that contain the thermoplastic resin as a principal component. However, if the thermoplastic resin is applied particularly to the base, such resin did not sufficiently satisfy the characteristics that are required for the base. For example, the moldings containing the thermoplastic resin set forth in Patent Application Publication (KOKAI) Hei 08-171847, the inorganic compound that has the dehydration reaction at 200° C. or more, and the reinforcement is excellent in the flame retardance and the insulating performance after the electrodes are opened/closed, and thus is suitable for the moldings of the circuit breaker. However, in case the thermoplastic resin is applied to the base which is used at the higher temperature and the higher stress than the cover, the handle, etc., especially the base whose temperature exceeds 100° C. at the time of current supply and which is subjected to the heavy stress via the crossbar, such thermoplastic resin is not sufficient since the reduction of overtravel in which the creep deformation generated under various conditions between the base and the crossbar takes part mutually is large.

Therefore, as the result of trial and error, the inventors of the present invention found that it is possible to employ the base that has the small reduction of overtravel, in which the creep deformation generated under various conditions takes part mutually, and that contains the thermoplastic resin as a principal component. Thus, the finding will be reported hereinafter.

The present invention has been made to overcome such problems, and it is an object of the present invention to provide a circuit breaker that is capable of decreasing the reduction of overtravel and thinning a thickness of the base and is gentle to the environment.

DISCLOSURE OF THE INVENTION

A circuit breaker according to the present invention comprises fixed contacts each having a fixed contact point; movable contacts each having a movable contact point that is connected/disconnected to/from the fixed contact point; a spring for applying a pushing force to both contact points when both contact points come into contact with each other; a crossbar formed integrally of insulating resin as a principal component to hold the movable contact swingably, and coupled to a lower link of a toggle link mechanism to swing around its swing axis with a motion of the toggle link mechanism; a switching mechanism portion for releasing an accumulated energy of a spring of the toggle link mechanism in response to a handle operation to execute quick-make and quick-break of the movable contact; and a molded case constructed by a base that fixes/supports the switching mechanism portion and a cover covered on the base from a handle side; wherein the base is a moldings that contains thermoplastic resin as a principal component to have a bending modulus of elasticity Eb at an ordinary temperature/ordinary humidity, and the crossbar is a moldings that has a bending modulus of elasticity Ec at an ordinary temperature/ordinary humidity, and following relationships are satisfied.

$$Eb+Ec \geqq 17000 \text{ MPa} \quad (1)$$

$$8000 \text{ MPa} \leqq Eb \quad (2)$$

$$9000 \text{ MPa} \leqq Ec \quad (3)$$

Therefore, the reduction of overtravel is small, the thickness and the weight of the base can be reduced, and this circuit breaker is gentle to the environment.

Also, the bending moduli of elasticity Eb, Ec satisfy following relationships.

$$Eb+Ec \geqq 205000 \text{ MPa} \quad (4)$$

$$9000 \text{ MPa} \leqq Eb \quad (5)$$

$$9000 \text{ MPa} \leqq Ec \quad (6)$$

Therefore, the reduction of overtravel can be further reduced.

Also, the bending moduli of elasticity Eb, Ec satisfy following relationships.

$$Eb+Ec \geqq 25000 \text{ MPa} \quad (7)$$

$$9000 \text{ MPa} \leqq Eb \leqq 22000 \text{ MPa} \quad (8)$$

$$9000 \text{ MPa} \leqq Ec \leqq 17000 \text{ MPa} \quad (9)$$

Therefore, the reduction of overtravel can be further more reduced, the productivity of molding can be improved, and the outer appearance is excellent.

Also, the thermoplastic resin is at least any one of polybutylene terephthalate, polyethylene terephthalate, polyamide, aliphatic polyketone, polyphenylene sulfide, and their alloy material. Therefore, the circuit breaker is excellent in the chemical resistance and the environment resistance and the recycle can be easily accomplished.

Also, the polyamide is at least any one of nylon 66, nylon MXD6, nylon 46, and nylon 6T. Therefore, the circuit breaker is excellent in the impact resistance and the holding characteristic against the heat generated in the make and break durability test.

Also, the thermoplastic resin is at least any one of polyethylene terephthalate, polyphenylene sulfide, and their alloy material. Therefore, the dimensional change due to moisture absorption is small and the holding characteristic against the heat generated in the make and break durability test is high.

Also, the base contains polybutylene terephthalate of 55 to 70 wt % to which a flame retardant is added, and reinforcement of 30 to 45 wt %. Therefore, the crack is hard to occur when terminals are fastened.

Also, the base contains polyethylene terephthalate of 40 to 70 wt % to which a flame retardant is added, and reinforcement of 30 to 60 wt %. Therefore, the base is excellent in the heat resistance and the creep resistance.

Also, the base contains polyamide of 56 to 60 wt % to which a flame retardant and elastomer are added, and reinforcement of 40 to 44 wt %. Therefore, the base is excellent in the impact resistance and the insulating performance after the shut-off.

Also, the crossbar contains phenol resin as a principal component. Therefore, the crossbar is excellent in the flame retardance and the overtravel characteristic can be improved much more.

Also, the circuit breaker is a multipolar type, and has slits in walls, that orthogonally intersect with a bottom wall of the base, to extend in its wall direction. Therefore, the dimensional change after the molding is small, and the slits can contribute to the reduction of the overtravel.

Also, the slits divide an orthogonal wall to have a uniform thickness. Therefore, it is possible to estimate easily the dimensional change after the molding, and the slits can contribute to the reduction of the overtravel.

Also, the slits are provided alternatively from front and back surface sides of the base. Therefore, the dimensional change after the molding can be further reduced, and the slits can contribute to the reduction of the overtravel.

Also, the orthogonally intersecting walls are interphase walls. Therefore, the walls can contribute to the reduction of the overtravel.

Also, a base thickness between the slits is equal to that of a base bottom wall. Therefore, it is possible to estimate easily the dimensional change after the molding, and the slits can contribute to the reduction of the overtravel.

Also, the orthogonally intersecting walls are a wall provided between a contact point housing portion for housing the movable contact point and the fixed contact point and a switching mechanism housing portion for housing a switching mechanism portion. Therefore, the thermal conductivity from the contact point side to the switching mechanism portion can be lowered, and thus the degradation of the lubricant used in the switching mechanism portion, etc. can be delayed.

Also, the slits are formed to be opened on a back surface side of the base. Therefore, the heat can be radiated effectively.

Also, thicknesses of walls between the slits and an inside of the base are formed thinner than a thickness of the base bottom wall. Therefore, the heat is ready to transfer from the inside of the base to the slits.

Also, the base contains polyamide of 56 to 60 wt % to which a flame retardant and elastomer are added, and reinforcement of 40 to 44 wt %. Therefore, the reduction of overtravel is small, and the thinning and the lightweight of the base can be accomplished, and the base is gentle to the environment. Also, since the thinning of the base can be reduced, the surface insulating distance can be extended. In addition, the base is excellent in the impact resistance and the insulating performance after the shut-off.

Also, the crossbar contains phenol resin of 28 to 32 wt %, reinforcement of 43 to 47 wt %, and inorganic filler of 23 to 27 wt %. Therefore, the reduction of overtravel is reduced much more.

Also, the flame retardant and the elastomer are contained such that halogen compound has a weight percent of 50 to 70 and the elastomer has a weight percent of 20 to 30 to polyamide 100. Therefore, the reduction of overtravel is small, and the flame retardance is high, and the crossbar is excellent in the impact resistance.

Also, the base contains polyethylene terephthalate of 45 to 60 wt % to which a flame retardant is added, and reinforcement of 40 to 55 wt %. Therefore, the reduction of overtravel is small, and the thinning and the lightweight of the base can be accomplished, and the base is gentle to the environment. Also, since the thinning of the base can be reduced, the surface insulating distance can be extended.

Also, the crossbar contains phenol resin of 55 to 65 wt %, reinforcement of 10 to 25 wt %, and inorganic filler of 10 to 25 wt %. Therefore, the molding is easy and the hopper dropping property in the continuous molding is excellent.

Also, the crossbar contains phenol resin of 25 to 35 wt %, reinforcement of 40 to 50 wt %, and inorganic filler of 20 to 30 wt %. Therefore, the reduction of overtravel is reduced much more.

Also, the flame retardant is contained such that halogen compound has a weight percent of 25 to 40 to polyethylene terephthalate 100. Therefore, the reduction of overtravel is small, and the flame retardance is high, and the crossbar is excellent in the impact resistance.

Also, the base contains polyethylene terephthalate of 40 to 70 wt % to which a flame retardant is added, and reinforcement of 30 to 60 wt %, and the crossbar contains phenol resin of 25 to 35 wt %, reinforcement of 40 to 50 wt %, and inorganic filler of 20 to 30 wt %. Therefore, the reduction of overtravel is small, and the thinning and the lightweight of the base can be accomplished, and the base is gentle to the environment. Also, since the thinning of the base can be reduced, the surface insulating distance can be extended. In addition, the base is excellent in the heat resistance.

Also, the base contains polyethylene terephthalate of 40 to 70 wt % to which a flame retardant is added, and reinforcement of 30 to 60 wt %, and the crossbar contains phenol resin of 55 to 65 wt %, reinforcement of 10 to 25 wt %, and inorganic filler of 10 to 25 wt %. Therefore, the reduction of the overtravel is small and the moldability is excellent.

Also, the base contains polyethylene terephthalate of 55 to 70 wt % to which a flame retardant is added, and reinforcement of 30 to 45 wt %. Therefore, the reduction of overtravel is small, and the thinning and the lightweight of the base can be accomplished, and the base is gentle to the environment. Also, since the thinning of the base can be reduced, the surface insulating distance can be extended. In addition, the molding of the fine parts can be implemented. The crack is hard to occur at the time of terminal fastening.

Also, the crossbar contains phenol resin of 25 to 35 wt %, reinforcement of 40 to 50 wt %, and inorganic filler of 20 to 30 wt %. Therefore, the reduction of the overtravel can be reduced much more.

Also, the crossbar contains phenol resin of 55 to 65 wt %, reinforcement of 10 to 25 wt %, and inorganic filler of 10 to 25 wt %. Therefore, the molding is easy and the hopper dropping property in the continuous molding is excellent.

Also, the flame retardant is contained such that halogen compound has a weight percent of 25 to 40 to polyethylene terephthalate 100. Therefore, the reduction of overtravel is small, and the flame retardance is high, and the crossbar is excellent in the impact resistance.

Also, main resin of the base is formed of thermoplastic resin, and slits are provided in walls, that orthogonally intersect with a bottom wall of the base, to extend in its wall direction. Therefore, the dimensional change after the molding is small and the base can contribute to the reduction of the overtravel.

Also, the slits divide an orthogonal wall to have a uniform thickness. Therefore, the dimensional change after the molding can be easily estimated and the slits can contribute to the reduction of the overtravel.

Also, the slits are provided alternatively from front and back surface sides of the base. Therefore, the dimensional change after the molding can be further reduced and the slits can contribute to the reduction of the overtravel.

Also, the orthogonally intersecting walls are interphase walls. Therefore, the walls can contribute much more to the reduction of the overtravel.

Also, a base thickness between the slits is equal to that of abase bottom wall. Therefore, the dimensional change after the molding can be easily estimated and the base can contribute to the reduction of the overtravel.

Also, the orthogonally intersecting walls are a wall provided between a contact point housing portion for housing the movable contact point and the fixed contact point and a switching mechanism housing portion for housing a switching mechanism portion. Therefore, the thermal conductivity from the contact point side to the switching mechanism portion can be lowered, and thus the degradation of the lubricant used in the switching mechanism portion, etc. can be delayed.

Also, the slits are formed to be opened on a back surface side of the base. Therefore, the heat can be radiated effectively.

Also, thicknesses of walls between the slits and an inside of the base are formed thinner than a thickness of the base bottom wall. Therefore, the heat is ready to transfer from the inside of the base to the slits.

BEST MODE FOR CARRYING OUT THE INVENTION

An embodiment of the present invention will be explained hereinafter.

Figure 1:
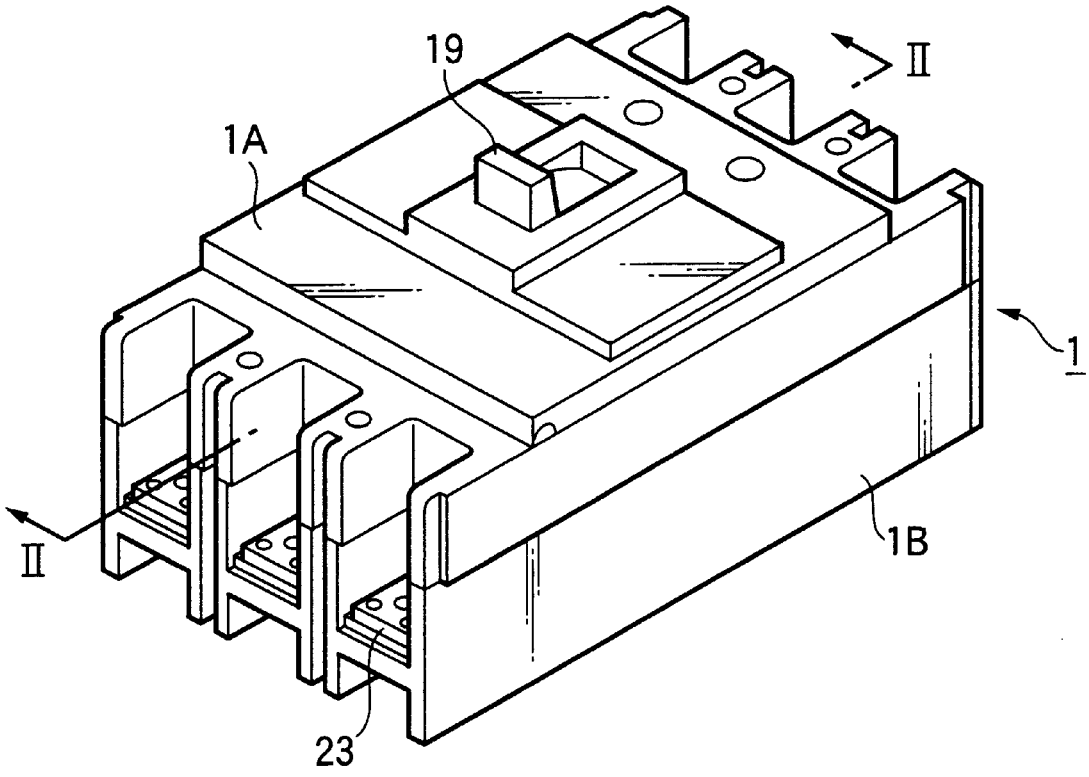
FIG. 1 is a perspective view showing a circuit breaker according to an embodiment of the present invention.
Figure 2:
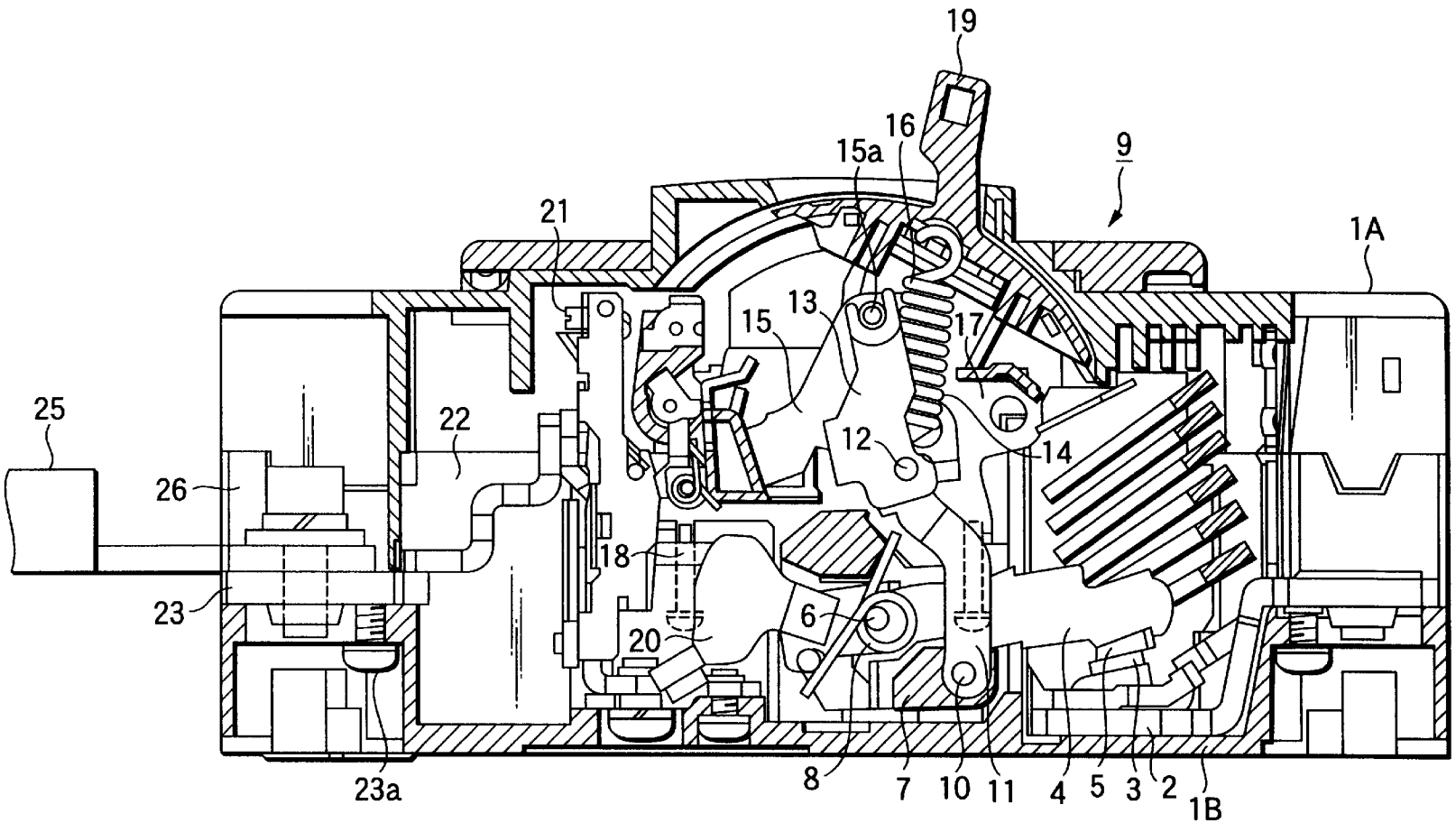
FIG. 2 is a view showing a closed state of the circuit breaker according to the embodiment of the present invention.
Figure 3:
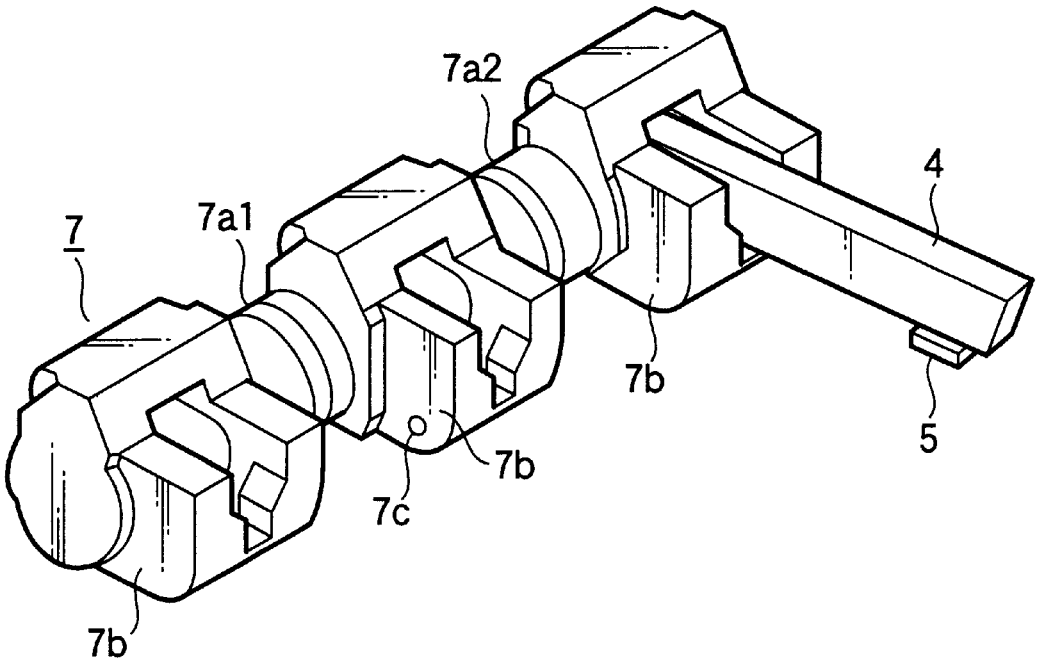
FIG. 3 is a perspective view showing a crossbar of the circuit breaker according to the embodiment of the present invention.

FIG. 1 is a perspective view showing a circuit breaker according to an embodiment of the present invention. FIG. 2 is a view showing a closed state of the circuit breaker according to the embodiment of the present invention, wherein cross sections of a base and a crossbar, taken along a II—II line in FIG. 1, are shown and also other portions, e.g., a switching mechanism portion, etc. are shown to easily understand their structures. FIG. 3 is a perspective view showing the crossbar of the circuit breaker according to the embodiment of the present invention, wherein a movable contact of only one pole is shown.

In FIG. 1, 1 denotes a molded case consisting of a cover 1A and a base 1B. The main part of the base 1B is formed of thermoplastic resin moldings. In FIG. 2, 2 denotes a fixed contact mounted on the base 1B and having a fixed contact point 3, and 4 denotes a movable contact having a movable contact point 5 that opposes to the fixed contact point 3. The movable contact 4 is supported swingably by a pivot pin 6.

Figure 6:
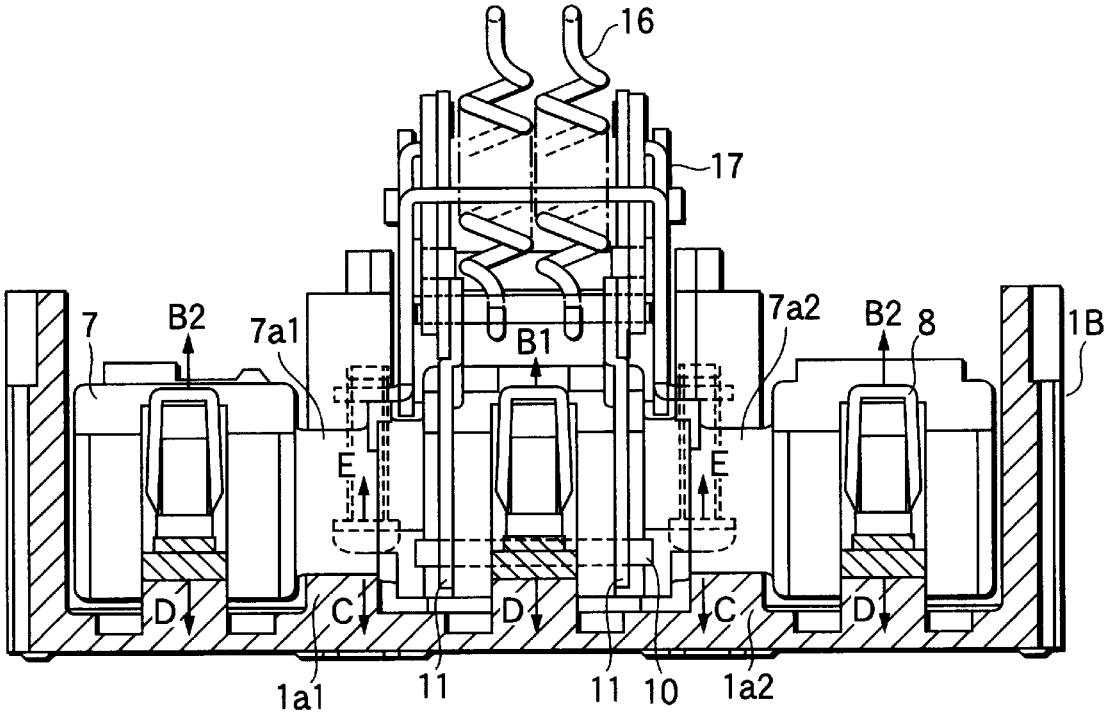
FIG. 6 is a sectional view, viewed from the contact point side, showing the crossbar and the contact point portions according to the embodiment of the present invention.

7 denotes a crossbar which is formed of insulating material and to which the pivot pins 6 of respective poles are fixed, and which holds swingably the movable contacts 4 of respective poles by its holding portions 7*b* (FIG. 3). The crossbar 7 is driven via pins 10, that are inserted into pin holes 7*c* (FIG. 3), of a switching mechanism portion 9 described later to swing the movable contacts 4 of respective poles such that the movable contact point 5 can be connected/disconnected to/from the fixed contact point 3. As shown in FIG. 3 and FIG. 6, rotation axes 7*a*1, 7*a*2 of the crossbar 7 are supported by supporting portions 1*a*1, 1*a*2 of the base 1B in the closed state of the circuit breaker.

Returning to FIG. 2, 8 denotes a spring that is interposed between the movable contacts 4 and the crossbar 7, and that pushes always the movable contacts 4 to the closing direction of the movable contacts 4 (the clockwise direction in FIG. 2) in the closed state of the circuit breaker to apply a predetermined contact pressure to both contact points 3, 5. 10 denotes a coupling pin that couples a lower link 11 of the switching mechanism portion 9 to the crossbar 7 to transmit a driving force of the lower link 11 to the crossbar 7. 18 is a screw that fixes a frame 17 onto the base 1B.

20 is a flexible conductor that connects electrically the movable contacts 4 and an overcurrent sensing portion 21. The overcurrent sensing portion 21 consists of a bimetal that is deformed in response to a supplied current, and an electromagnetic unit whose armature is sucked into a yoke in response to the supplied current. 22 is a conductor that connects electrically the overcurrent sensing portion 21 and a terminal plate 23. The terminal plate 23 is fixed onto the base 1B by fastening screws 23*a*, and an external electric cable 25 is fixed by fastening screws 26.

At this time, a current path in the circuit breaker is constructed via a route consisting of the fixed contact 2, the fixed contact point 3, the movable contact point 5, the movable contact 4, the flexible conductor 20, the overcurrent sensing portion 21, the conductor 22, and the terminal plate 23.

The switching mechanism portion 9 is constructed by a toggle link mechanism, a frame 17, a handle 19, etc., and the toggle link mechanism is composed of a lower link 11, a link pin 12, an upper link 13, a lever pin 14, a lever 15, a main spring 16, etc. When an action line of the main spring 16 exceeds a dead point of the toggle link mechanism by operating the handle 19, the toggle link mechanism can be expanded quickly in the ON operation and also the toggle link mechanism can be folded quickly in the OFF operation, so that the movable contact 4 can be opened/closed irrespective of the operation speed of the handle 19. Also, a latch (unnumbered) is released by a releasing action of the overcurrent sensing portion 21, then the lever 15 latched by this latch is released from the restriction, and then a link pin 15*a* exceeds an action line of the main spring 16, whereby the toggle link mechanism can be folded quickly to open the movable contact point 5.

In this manner, the circuit breaker of the present invention has a function of executing the quick-make and quick-break and is excellent in the prevention of contact point deposition in the open/close operation and the concurrent closing of respective contacts, and corresponds to a molded case circuit breaker stipulated in IEC60947-2, for example.

Figure 4:
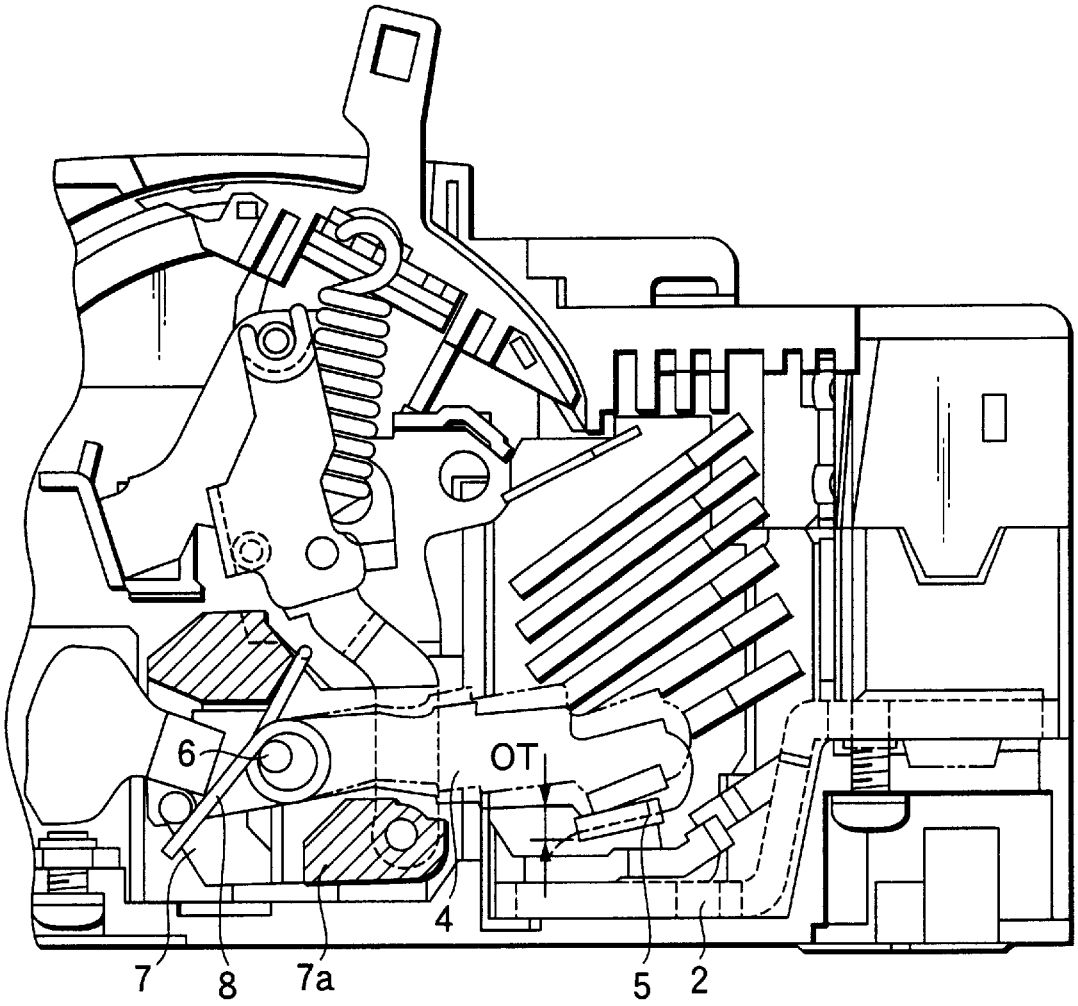
FIG. 4 is a view showing contact point portions of the circuit breaker according to the embodiment of the present invention in an enlarged manner.

FIG. 4 is a view showing contact point portions of the circuit breaker according to the embodiment of the present invention in an enlarged manner. A broken line indicates the closed state and a solid line indicates the state that the fixed contact and the fixed contact are removed from the closed state. In FIG. 4, if the fixed contact 2 and the fixed contact point 3 are removed from the closed state indicated by the broken line, the movable contact 4 is swung by a pushing force of the spring 8 around the pivot pin 6 until it comes into contact with a latching portion 7*a* of the crossbar 7. An amount of the movable contact point 5 at this time is called the "overtravel". Normally this overtravel is about one to two times a thickness of the fixed contact point 3, and is indicated by OT in FIG. 4. This overtravel is provided to get the stability of the contact even when the contact points 3, 5 are worn away and eroded away by the arc that is generated by the repetition of the opening/closing operations and the opening/closing in the current supply due to the electrical and mechanical or both factors, and even when the base 1B and the crossbar 7 are deformed (especially, the creep deformation) to relax the contact between the contact points 3, 5. In this case, in the circuit breaker employing the conventional base that contains the thermosetting resin as a principal component, the influence of the latter deformation is sufficiently smaller than that of the former wear/erosion of the contact point with respect to the influence on the overtravel, so that the latter deformation was not so considered.

Figure 5:
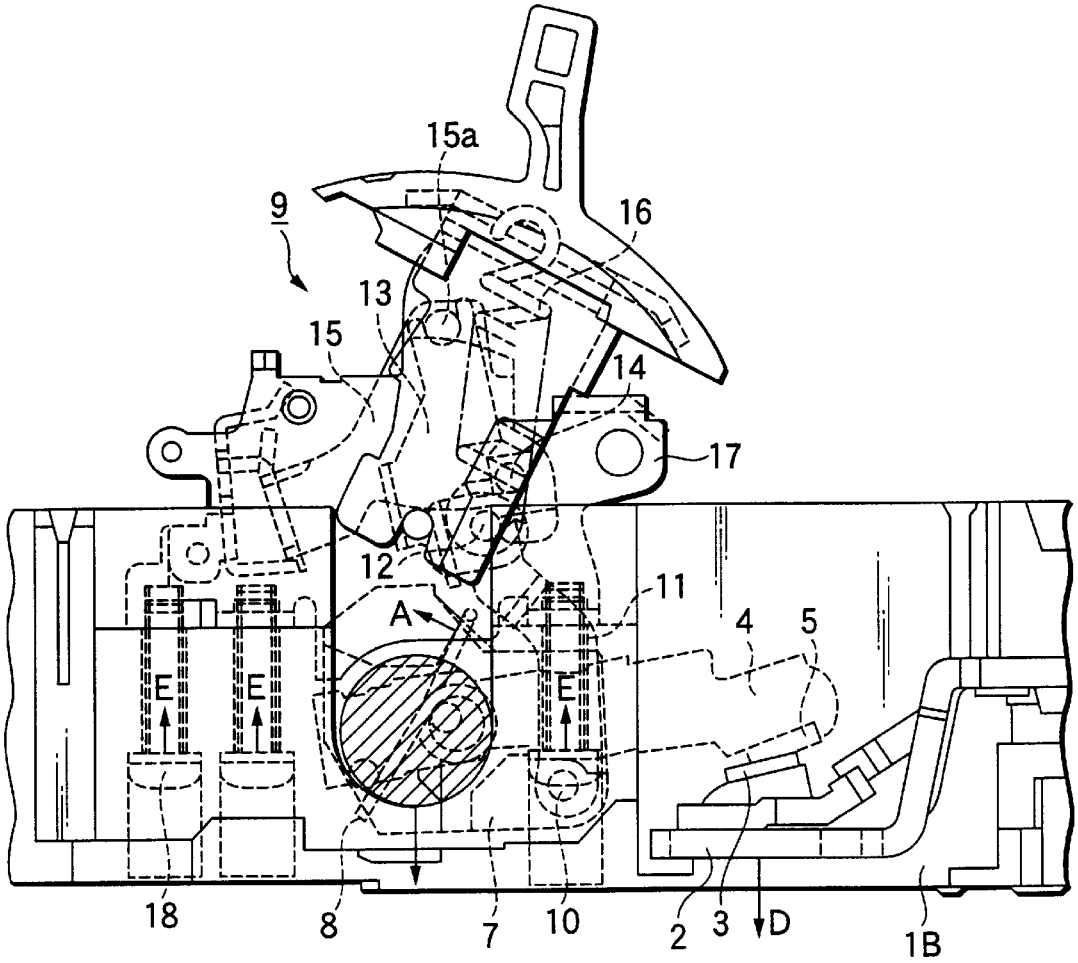
FIG. 5 is a view showing a coupled state between a base and a switching mechanism portion of the circuit breaker according to the embodiment of the present invention.

FIG. 5 is a view showing the coupled state between the base and the switching mechanism portion of the circuit breaker according to the embodiment of the present invention. The switching mechanism portion 9 is fixed to the base 1B via the frame 17 by screws 18. Also, the upper link 13 is latched by a burring axis 15*a* that is formed integrally with the lever 15. This lever 15 is rotated around the lever pin 14 that is formed integrally with the frame 17 of the switching mechanism portion 9. The upper link 13 and the lower link 11 are coupled by the link pin 12, and the load of the main spring 16 is applied to the link pin 12.

In the closed state, a contacting pressure is applied by the spring 8 between the fixed contact point 3 and the movable contact point 5, and thus the fixed contact 2 to which the fixed contact point 3 is adhered is fixed to the base 1B. Therefore, the load is always applied to the crossbar 7 as the reaction via the movable contact 4 and the spring 8 in the direction indicated by an arrow A.

Also, a component of force of the load A pushes upwardly the toggle link mechanism consisting of the upper link 13, the lower link, etc. via the coupling pin 10, and as a result it pushes upwardly the lever 15 and then the frame 17. Accordingly, in the closed state, the upward load E is always applied mainly to the portion in which the screws 18 are inserted into the base 1B.

FIG. 6 is a sectional view, viewed from the contact point side, showing the crossbar and the contact point portions according to the embodiment of the present invention. In the closed state, an upward load B1 is always applied to the central pole of the crossbar 7 by the load of the spring 8. An upward load B2 is always applied to right and left poles of the crossbar 7 respectively. Also, a downward C (also shown in FIG. 5) load is always applied to supporting portions 1*a*1, 1*a*2 of the base 1B from the rotation axes 7*a*1, 7*a*2 of the crossbar 7 respectively. Also, a downward (also shown in FIG. 5) load D is always applied to the base 1B via the fixed contact 2, and also an upward load E is applied to the base 1B via the frame 17 and the screws 18.

If the ampere-frame of the circuit breaker is increased larger, the load of the main spring 16, the load of the spring 8 applied always to the crossbar 7 in the A direction, the upward load E applied mainly to the portions in which the screws 18 are inserted into the base 1B, the loads B1, B2 applied to the crossbar 7, and the downward C load received from the rotation axes 7*a*1, 7*a*2 of the crossbar 7 are also increased.

As described above, when the circuit is closed and the opening/closing operations are executed, the dimensional change due to the applied load and the moment based on the load and the residual stress relaxation depending on the use temperature of the base 1B and the crossbar 7, and the dimensional change due to the moisture absorption are caused in the base 1B and the crossbar 7, and the creep deformation makes progress under the conditions of the temperature, the humidity, the time, the composition, etc. However, since various conditions are present, it is very difficult to estimate the amount of the creep deformation. This creep deformation is generated in the direction to relax the stress, i.e., the direction to reduce the overtravel respectively. Since the thermoplastic resin is employed as a main component of the base 1B, such a tendency appears that the reduction of the overtravel after the elapsed time is remarkable at an unnegligible level in the circuit breaker, that has the base 1B and the crossbar 7 both having the same ampere-frame, rather than the case where the thermosetting resin is employed as a main component. For example, the reduction of the overtravel of the circuit breaker, that employs the base having the composition set forth in Patent Application Publication (KOKAI) Hei 08-171847 to contain the thermoplastic resin as a principal component, was large.

When the moldings containing the thermoplastic resin as a principal component is employed as the base 1B of the circuit breaker, the inventors found the suitable composition of the base 1B and the crossbar 7 that is excellent in the overtravel characteristic. Also, the inventors found that the relationship of the bending modulus of elasticity between the base 1B and the crossbar 7 at the ordinary temperature/the ordinary humidity and the shape of the base 1B should be considered at that time.

Where the ordinary temperature is 21° C. to 25° C., and the ordinary humidity is 60% to 70% humidity. The bending modulus of elasticity at the ordinary temperature/the ordinary humidity is (an average value of) a measured value in the atmosphere of 21° C. to 25° C. and 60% to 70% humidity.

Bending Modulus of Elasticity of the Base and the Crossbar

Base

The base 1B is the moldings that contains the thermoplastic resin as a principal component and has the bending modulus of elasticity Eb at the ordinary temperature/the ordinary humidity. As the thermoplastic resin, there may be listed polybutylene terephthalate (PBT), polyethylene terephthalate (PET), polyamide (PA), aliphatic polyketone, polyphenylene sulfide (PPS), and their alloy material, for example. Polyamide contains the amide group (—CO—NH—) in the chemical structure, and there may be listed nylon 6, nylon 66, nylon MXD6, nylon 46, nylon 6T, or their alloy material.

Also, polybutylene terephthalate (PBT), polyethylene terephthalate (PET), polyamide (PA), aliphatic polyketone, polyphenylene sulfide (PPS), or their alloy material is the crystalline resin, and has the advantage that is excellent in the chemical resistance and the environment resistance rather than the noncrystal resin such as polycarbonate (PC), etc. Accordingly, the circuit breaker can be employed for a long term in various environments such as the oil mist (oil smoke) atmosphere, the ammonia gas atmosphere, the sulfuric gas atmosphere, etc.

Also, polyamide in the thermoplastic resin has the advantages that the impact resistance is excellent, the insulating performance of the material surface by the arc exposure in the breaking operation is hard to lower, and others. In addition, nylon 66, nylon MXD6, nylon 46, or nylon 6T is preferable from the point of the shape maintaining property (heat resistance) in the make and break durability test at which the supply and the cut-off of the rated current are repeated.

Also, polybutylene terephthalate (PBT), polyethylene terephthalate (PET), aliphatic polyketone, polyphenylene sulfide (PPS), and their alloy material are desirable from the points that the bending modulus of elasticity is difficult to reduce at the time of moisture absorption and the dimensional change due to the moisture absorption is small. In addition, polybutylene terephthalate (PET), polyphenylene sulfide (PPS), or their alloy material is desirable from the point of the shape maintaining property (heat resistance) in the above make and break durability test.

As the components other than the thermoplastic resin, there may be listed the reinforcement such as the glass fiber, etc., the inorganic filler, the additive, and others.

Crossbar

The crossbar 7 is the moldings having the bending modulus of elasticity Ec at the ordinary temperature/the ordinary humidity. As the insulating resin as a principal component of the moldings, preferably there may be listed unsaturated polyester, the phenol resin, etc. in addition to the same as the base 1B.

The phenol resin is excellent in the high temperature creep characteristic rather than the thermoplastic resin and the unsaturated polyester, and such resin can be fitted to both the injection molding and the compression molding and thus can be easily molded. Both the novorak phenol resin and the resol phenol resin may be employed, but the novorak phenol resin is desirable from the point of dimensional stability of the moldings. Also, wood flour as the organic filler, powdered cloth, polyamide, polyester, polyacryl, etc. are contained in the resin as the principal component of the crossbar 7. In other words, in the present specification, the filler of the crossbar 7 signifies the inorganic filler and the organic filler is contained in the insulating resin. This is because of the characteristics such that the inorganic filler contributes mainly to the improvement in the strength and the bending modulus of elasticity of the moldings whereas the organic filler does not so contribute to the improvement in the bending modulus of elasticity rather than the inorganic filler but contributes mainly to the improvement in the moldability and the impact resistance of the moldings.

As the components other than the insulating resin, there may be listed the reinforcement such as the glass fiber, etc., the inorganic filler, the additive, and others.

Followings will be given as the glass fiber, the inorganic filler, the additive, and others of the base 1B and the crossbar 7.

The glass fiber means the fibrous substance made of the glass, and is not particularly limited if a total contained amount of the 1 A group metal compound in the periodic table is satisfied. As the glass material, E glass, S glass, D glass, T glass, silica glass, etc. may be listed. As normally known, it is preferable from the point of improvement of the impact resistant strength that the diameter of the glass fiber should be set to 6 to 13 $\mu$m and the aspect ratio should be set to more than 10.

As the inorganic filler, alumina, calcium carbonate, mica, clay, talc, kaolin, walastenite, etc. may be listed.

As the additive, there are the internal remover such as calcium stearate, etc., the pigment such as the black carbon for the base 1B, for example.

Bending Modulus of Elasticity

The bending modulus of elasticity Eb of the base 1B at the ordinary temperature/the ordinary humidity and the bending modulus of elasticity Ec of the crossbar 7 at the ordinary temperature/the ordinary humidity satisfy the following relationship. Normally there is such a tendency that the bending modulus of elasticity is reduced with the increase of the temperature and the humidity $$Eb+Ec \geqq 17000 \text{ MPa} \quad (1)$$

$$8000 \text{ MPa} \leqq Eb \quad (2)$$

$$9000 \text{ MPa} \leqq Ec \quad (3)$$

It was found experimentally that the overtravel characteristic in which the creep resistance characteristic of the base 1B and the crossbar 7 may be supposed as the main cause becomes excellent based on such combination. At this time, if at least any one of Eb<8000 MPa and Ec<9000 MPa is satisfied, the overtravel characteristic is reduced.

Also, since the overtravel characteristic is excellent much more, it is preferable that the bending modulus of elasticity Eb of the base 1B at the ordinary temperature/the ordinary humidity and the bending modulus of elasticity Ec of the crossbar 7 at the ordinary temperature/the ordinary humidity should satisfy the following relationship.

$$Eb+Ec \geqq 205000 \text{ MPa} \quad (4)$$

$$9000 \text{ MPa} \leqq Eb \quad (5)$$

$$9000 \text{ MPa} \leqq Ec \quad (6)$$

At this time, if at least any one of Eb+Ec<20500 MPa, Eb<9000 MPa, and Ec<9000 MPa is satisfied, the overtravel characteristic is reduced.

Also, since the reduction of the overtravel after the elapsed time is reduced and the reliability is further improved, it is preferable that the bending modulus of elasticity Eb of the base 1B at the ordinary temperature/the ordinary humidity and the bending modulus of elasticity Ec of the crossbar 7 at the ordinary temperature/the ordinary humidity should satisfy the following relationship.

$$Eb+Ec \geqq 25000 \text{ MPa} \quad (7)$$

$$9000 \text{ MPa} \leqq Eb \leqq 22000 \text{ MPa} \quad (8)$$

$$9000 \text{ MPa} \leqq Ec \leqq 17000 \text{ MPa} \quad (9)$$

At this time, if Eb is in excess of 22000 MPa, rates of the glass fiber and the inorganic filler are increased. Thus, when the base 1B is molded, the flowability of the material at the time of molding is deteriorated and the filler appears on a surface of the moldings to make worse the appearance of the moldings. Therefore, it is preferable that Eb should be set to Eb≦2000 MPa.

Also, the crossbar 7 can be supplied by any molding method of the injection molding and the compression molding. In this case, the injection molding is desired from the point of high productivity. In the case that the crossbar 7 is molded by the injection molding, if the bending modulus of elasticity Ec is in excess of 17000 MPa, break of the glass fiber is reduced in the material kneading step and thus a length of material pellet becomes too long. Then, the material pellet is difficult to drop into the cylinder from the hopper and thus there is such a tendency that the material measuring characteristic by the cylinder is degraded. Therefore, it is preferable that Ec should be set to Ec≦17000 MPa.

As described above, since the base 1B contains the thermoplastic resin as a principal component, the problem of the industrial waste product process such as incineration or burying of the flash generated in the molding or the sprue, the runner, etc. generated in the injection molding does not arise in contrast to the case where the base 1B contains the thermosetting resin as a principal component, and such base 1B is gentle to the environment. In addition, since the base 1B contains the thermoplastic resin as a principal component, it is possible to recycle the base 1B.

Also, since the base 1B contains the thermoplastic resin as a principal component, an insulating distance can be shortened based on the good tracking resistance in contrast to the case where the base 1B contains the phenol resin as a principal component, and also the ammonia as the by-product in the phenol manufacturing process is not generated. Also, there is not caused the problem that unreacted styrene is generated in practical use in contrast to the case where the principal component of the base 1B is formed of the unsaturated polyester resin, and Also, since the base 1B contains the thermoplastic resin as a principal component, the rib having a height of more than 2 mm, for example, can be molded to have a thickness of less than 2 mm and thus the thin thickness design can be achieved. Then, if the thinning can be achieved, the number of the ribs and the grooves in the same space can be increased and also the insulating distance via the surface of the moldings can be set large, otherwise the same insulating distance can be assured in the smaller space and thus the size reduction of the product can be attained. Also, according to the base 1B that contains the thermoplastic resin as a principal component, the problems such that the insufficient strength due to the insufficient filling of the material into the thin top end of the rib and the insufficient filling of the reinforcement such as the glass fiber, etc. becomes remarkable according to the molding conditions and the material physical property and that the thinning is difficult can be overcome since the base 1B is formed as the moldings that contains the thermoplastic resin as a principal component so as to fill the material into the thin top end.

Also, since the base 1B contains the thermoplastic resin as a principal component, the lightweight of the circuit breaker can be accomplished.

Shape of the Base

Figure 7:
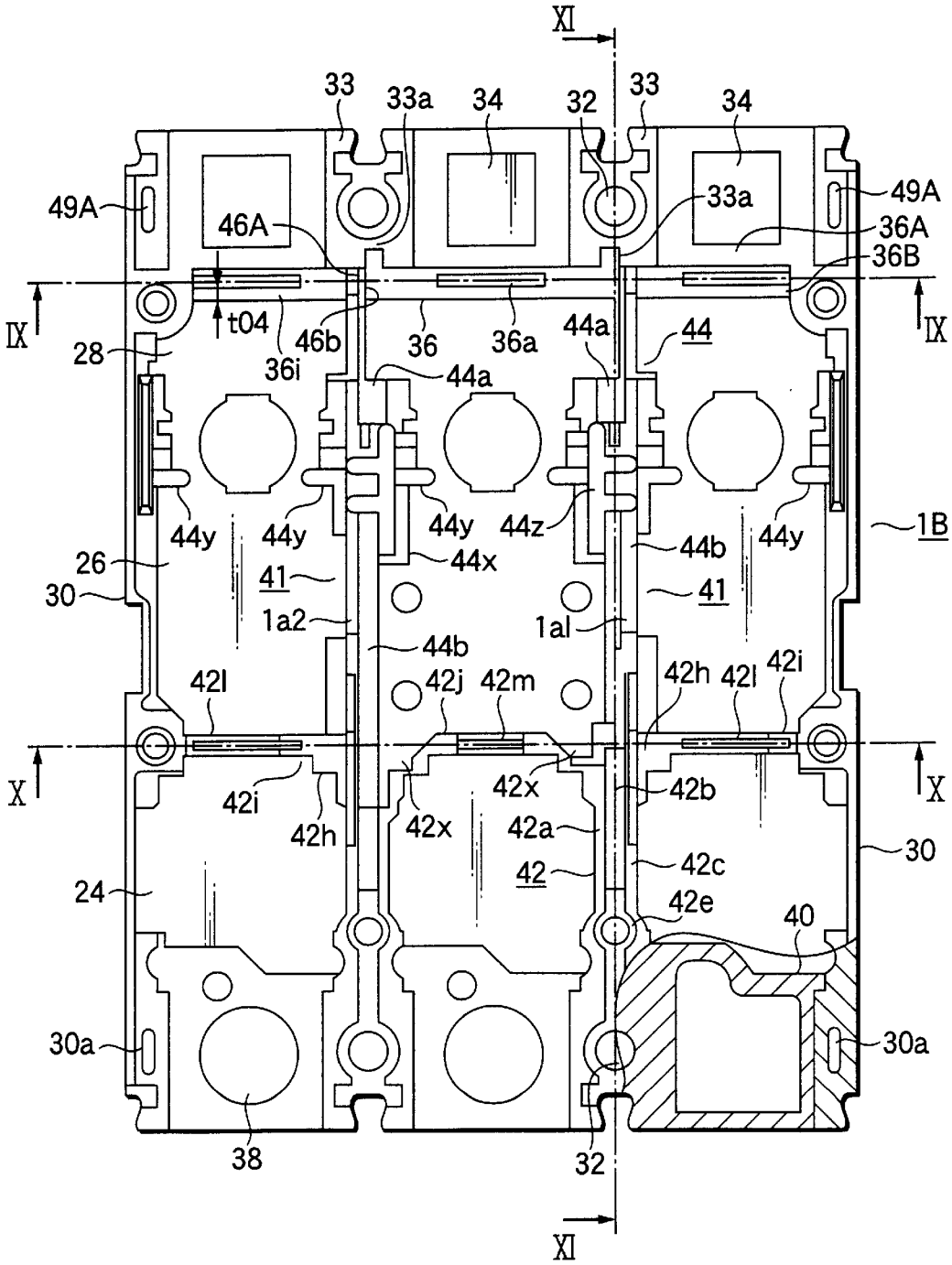
FIG. 7 is a front view showing the partially notched base of the circuit breaker according to the embodiment of the present invention.
Figure 8:
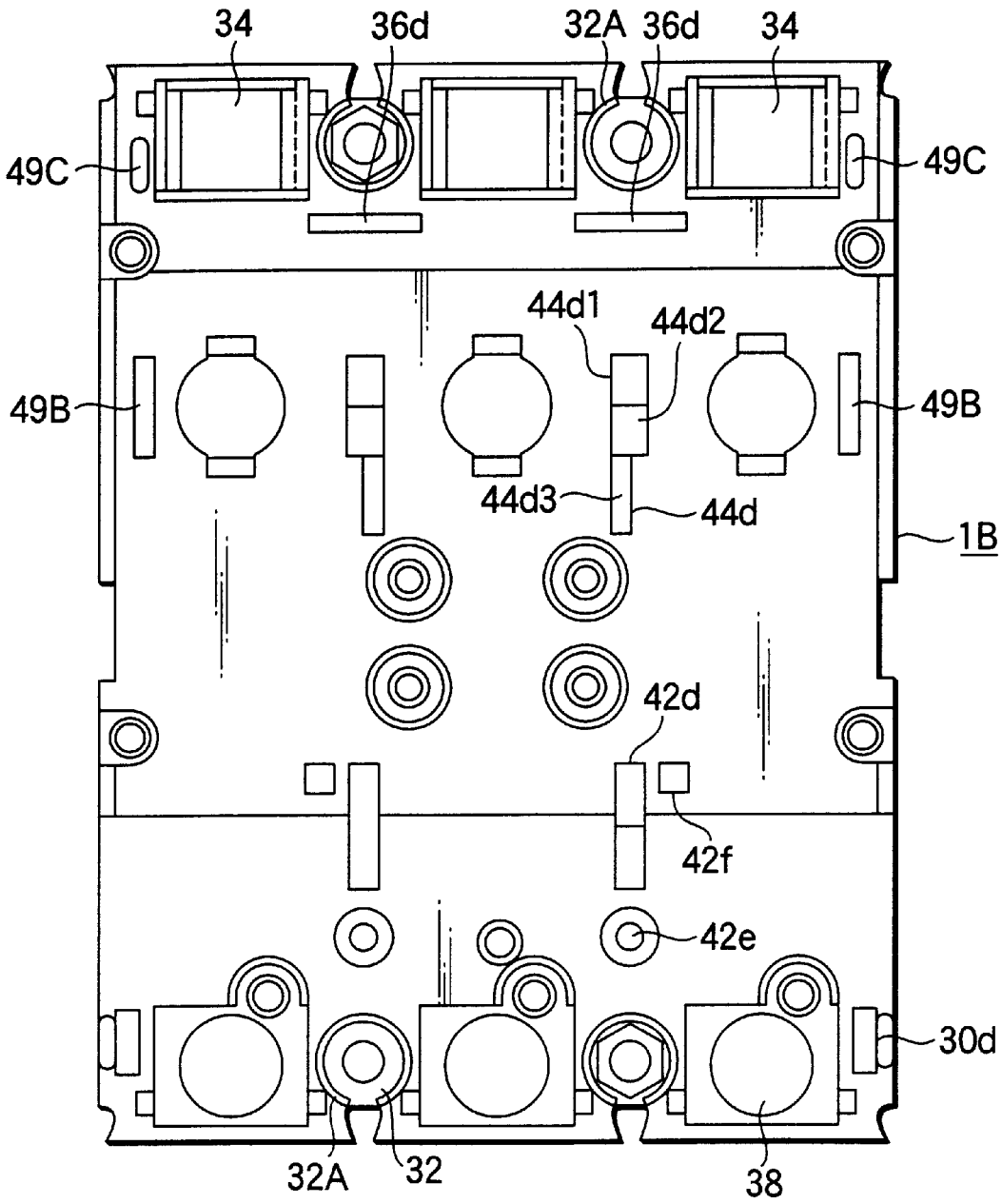
FIG. 8 is a bottom view showing the base of the circuit breaker according to the embodiment of the present invention.
Figure 9:
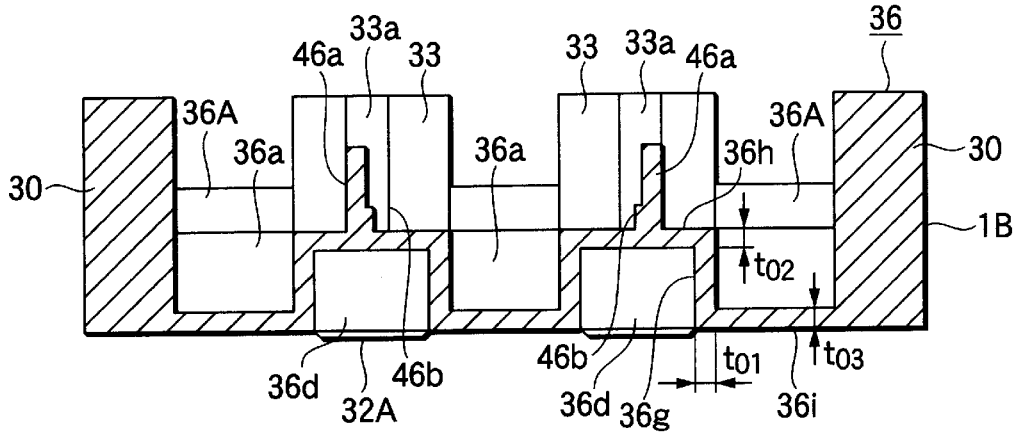
FIG. 9 is a sectional view taken along a IX—IX line in FIG. 7.
Figure 10:
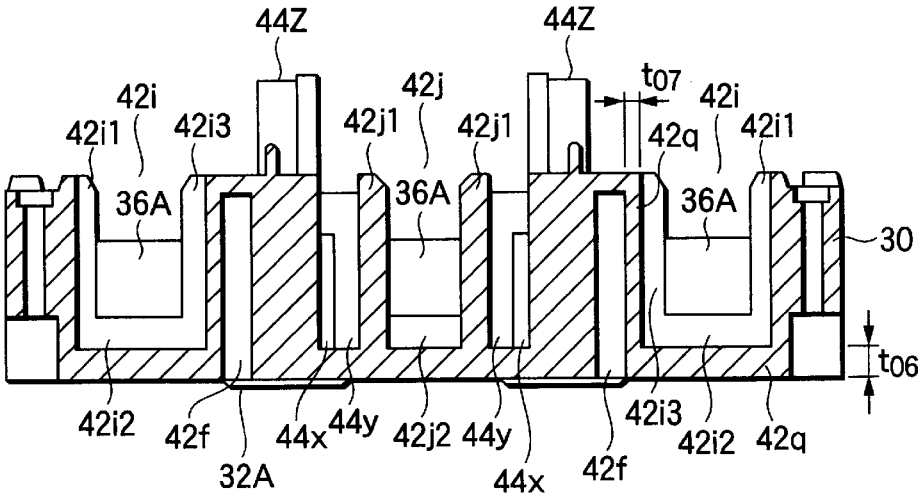
FIG. 10 is a sectional view taken along a X—X line in FIG. 7.
Figure 11:
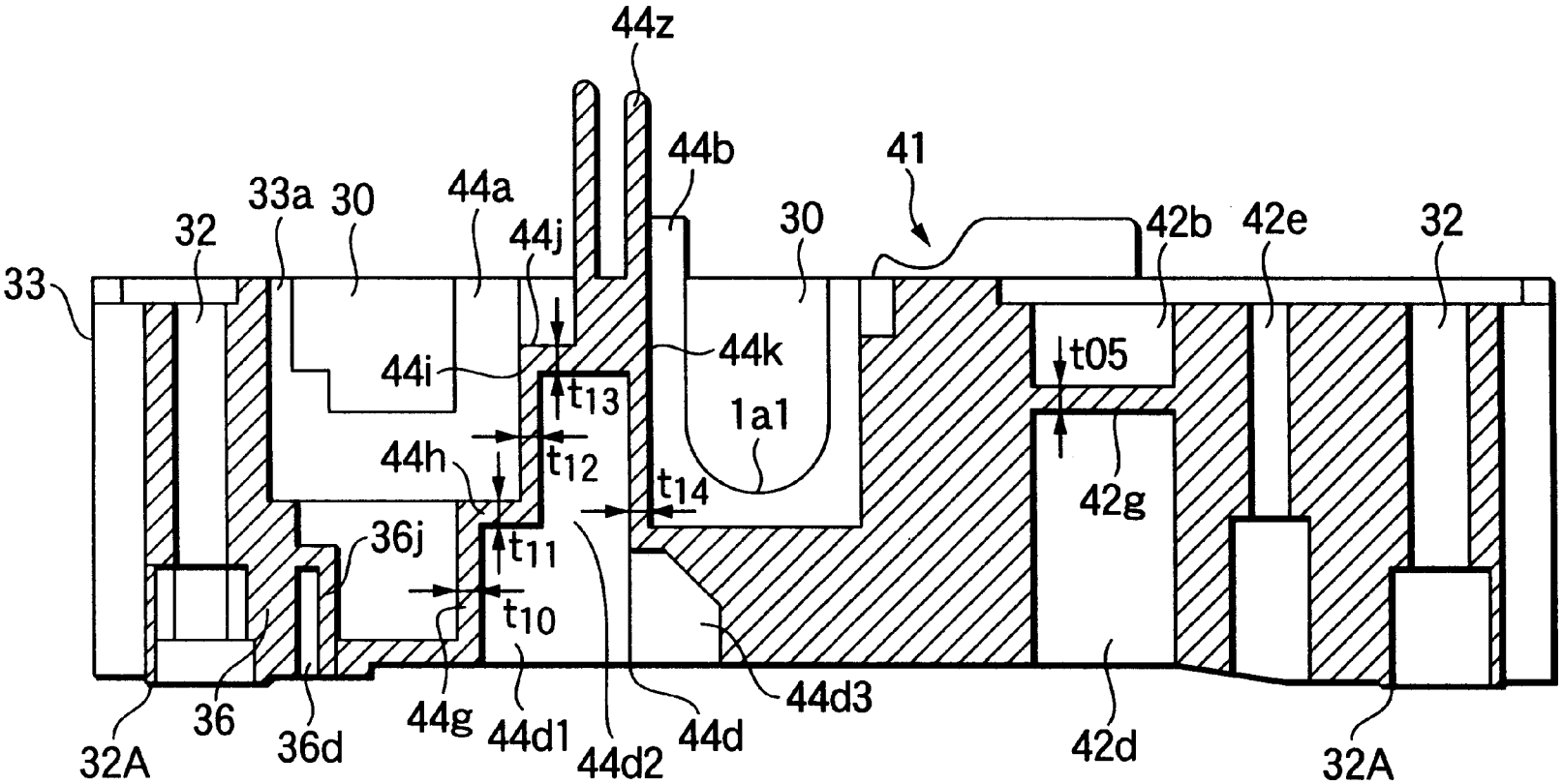
FIG. 11 is a sectional view taken along a XI—XI line in FIG. 7.

FIG. 7 is a front view showing a partial sectional shape of the base of the circuit breaker according to the embodiment of the present invention. FIG. 8 is a bottom view showing the base of the circuit breaker. FIG. 9 to FIG. 11 are sectional views taken along a IX—IX line, a X—X line, and a XI—XI line in FIG. 7 respectively.

In Figures, the base 1B is partitioned into three phases by outer side walls 30, 30 and interphase walls 41, 41 that are provided perpendicularly to the base bottom surface to extend in parallel mutually. Each phase is constructed by a contact point portion 24 in which both contact points 3, 5 are arranged, a crossbar portion 26 (switching mechanism housing portion) in which the crossbar 7 and the switching mechanism portion 9 are arranged, and a releasing portion 28 in which the overcurrent sensing portion 21 for sensing the overcurrent in the electric cables and lines in the closed state and then providing a trigger to the switching mechanism portion 9 to open the contact point is arranged.

32 is an insertion hole of the fitting screw for fitting the circuit breaker, and 32A (unnumbered in FIG. 1 to FIG. 6) is a supporting projection provided to project like an almost C-shape from a main surface of the back surface of the base 1B around the insertion hole 32. When the circuit breaker is fitted to the switchboard, the supporting projections 32A act as a spacer and thus the main surface of the back surface of the base 1B can be separated at a distance from the switchboard, etc. In this case, if the supporting projection 32A can perform a spacer function to separate the main surface of the back surface of the base 1B from the switchboard, etc., any shape and any arrangement position may be employed. 33 is an end portion of the interphase wall 41 on the releasing side, and a slit 33*a* into which a rib of the cover 1A is inserted is provided. 36 is a side wall of the releasing portion provided between a terminal fitting portion 34 and the releasing portion 28, and consists of a wall portion 36A provided to the terminal fitting portion 34 and a wall portion 36B provided to the releasing portion 28. In particular, in FIG. 9, slits 36*a* and slits 36*d* are provided alternatively in the wall portion 36B on the inner surface side (front surface side) and the back surface side of the base 1B in the orthogonal direction with each phase respectively. Accordingly, since the dimension of the base 1B after the molding is stabilized, such slits can contribute to the reduction of the overtravel. Also, since a thickness t01 of a wall 36*g* between the slits 36*a*, 36*d*, a thickness t02 of a front surface side wall 36*h* of the slit 36*d*, a thickness t03 of a back surface side wall 36*i* of the slit 36*a*, and a thickness t04 of a wall 36*j* (see FIG. 7) between the slit 36*a* and the releasing portion 28 are set substantially equal, such thicknesses can further contribute to the reduction of the overtravel.

In FIG. 7, 40 is a contact point side wall provided between the terminal fitting portion 38 and the contact point portion 24. Slits 30*a*, 30*d* are provided alternatively on the front surface and the back surface of the outer side walls 30 near the terminal fitting portions 38 and the contact point side walls 40 in the interphase direction respectively. The slits 30*a*, 30*d* divide the outer walls 30 uniformly in the thickness direction respectively.

The interphase wall 41 is constructed by an interphase wall portion 42 on the contact point side, supporting portions 1*a*1, 1*a*2, and an interphase wall portion 44 on the releasing unit side.

The interphase wall portion 42 is divided uniformly into a first phase side wall 42*a* and a second phase side wall 42*c* by a slit 42*b*. Also, the back surface side of the base 1B is divided uniformly into the first phase side wall 42*a* and the second phase side wall 42*c* by a slit 42*d*. The slit 42*b* and the slit 42*d* are partitioned by a wall 42*g* (FIG. 11) having a thickness t05. 42*e* is an insertion hole of a fixing screw for fixing the cover 1A to the base 1B.

Throttle portions 42*i*, 42*j*, 42*i* that are slightly wider than the movable contact 4 are provided on the supporting portions 1*a*1, 1*a*2 side of the interphase wall portion 42. 42*x* is a slit into which one end of the frame 18 is inserted.

The throttle portions 42*i* is composed of a rib 42*i*1 (FIG. 10) that extends to the interphase wall 41 side from the side wall 30, a rib 42*i*2 that extends to the cover 1A side from a base bottom wall 42*p*, and a rib 42*i*3 that extends to the side wall 30 side from the interphase wall 41. A slit 421 (FIG. 7) is provided in the ribs 42*i*1, 42*i*2, 42*i*3 respectively to prolong a creepage distance. A slit 42*f* (FIG. 8, FIG. 10) is provided to the base portion 42*h* between the rib 42*i*3 and the interphase wall 41 respectively.

The throttle portions 42*j* is composed of ribs 42*j*1 that extend to the interphase wall 41 side mutually, and a rib 42*j*2 that extends to the cover 1A side from the base bottom wall 42*p*. A slit 42*m* is provided to the ribs 42*j*1, 42*j*2, 42*j*1 in the extended direction respectively to prolong the creepage distance.

The throttle portions 42*i*, 42*j*, 42*i* and the base portions 42*h* act as the wall to partition the contact points 3, 5 and the switching mechanism portion 9, and suppress the gas, that is generated by the pressure rise caused when the arc is cut off after the contact points 3, 5 are opened, from flowing into the switching mechanism portion 9 side.

Also, the slit 42*f* is provided to the base portion 42*h* that acts as the wall for partitioning the contact points 3, 5 and the switching mechanism portion 9. Since the thermal conductivity of a space (i.e., an air layer) in the slit 42*f* is small rather than the case where the base portion 42*h* is filled with the resin, the thermal conductivity from the contact points 3, 5 to the switching mechanism portion 9 in the base 1B is lowered. Accordingly, the heat generation at the contact points 3, 5 in the current supply is difficult to transfer to the switching mechanism portion 9 side, and thus the progress of the degradation of the lubricant such as the oil, the grease, etc. used in the switching mechanism portion 9 can be delayed. Also, the main surface of the back surface of the base 1B is separated at a distance from the install surface of the switchboard, etc. by the supporting projections 32A and also the slits 42*f* are provided to the base 1B from the back surface side. Therefore, the radiation area is increased large rather than the case where the space is filled with the resin, thus the heat can be easily radiated to the outside of the base 1B, and thus the progress of the degradation of lubricant can be further delayed. Also, since a thickness t07 of the wall between the slit 42*f* and the inside of the base 1B, e.g., a slit wall 42*q*, is smaller than a thickness t06 (which is substantially equal to t01 to t05) of the base bottom wall 42*p*, the heat can be radiated effectively via the slit 42*f*.

The interphase wall portion 44 divides uniformly the first phase side (center phase in FIG. 7) and the second phase side (right phase in FIG. 7) by slits 44*a*, 44*d* (especially 44*d*2), 44*b* that are provided alternatively to the front surface and the back surface of the base 1B in the extended direction of the interphase wall 41. The slit 44*d* is constructed by spaces 44*d*1, 44*d*2, 44*d*3. A thickness t10 of a wall 44*g* between the slit 44*d* and the space on the releasing side end portion 33 side and thicknesses t11, t12, t13, t14 of walls 44*h*, 44*i*, 44*j*, 44*k* between the slit 44*d* and the slits 44*a*, 44*b* are substantially equal to the thickness t01 respectively. 44*x*, 44*y* are positioning convex portions, and 44*z* is a convex portion fitted into the cover 1A.

Since the slits 44*a*, 44*d* (especially 44*d*2), 44*b* are provided alternatively to the front surface and the back surface of the base 1B, the dimension of the base 1B after the molding can be stabilized and such slits can contribute to the reduction of the overtravel. Also, since the thicknesses t10, t11, t12, t13, t14 of the walls 44*g*, 44*h*, 44*i*, 44*j*, 44*k* are substantially equal, the dimension can be stabilized much more and thus such thicknesses can contribute to the reduction of the overtravel.

49A is a slit provided from the surface side of the base 1B to the side wall 30, and 49B, 49C are slits also provided from the surface side of the base 1B to the side wall 30.

As described above, it is found that, since the walls having the thickness of more than a predetermined value are divided uniformly by the slits 30*a*, 30*d*, 36*a*, 36*d*, 42*b*, 42*d*, 44*a*, 44*b*, 44*d*, 49A, 49B, 49C to have a predetermined thickness, the warp and the sink of the base 1B that contains the thermoplastic resin as a principal component after the molding can be relaxed to then enhance the dimensional precision and also the reduction of the overtravel based of the creep deformation of the base 1B and the crossbar 7 can be reduced.

Particularly, the reduction of the overtravel becomes conspicuous when the slits are provided to the interphase wall 41. Also, the reduction of the overtravel becomes conspicuous when the slits are provided alternatively to the front surface and the back surface of the base 1B.

In addition, since the walls 36*g*, 36*h*, 36*i*, 36*j*, 42*p*, 42*q*, 44*g*, 44*h*, 44*i*, 44*j*, 44*k*, in which the slits are formed, are formed to have the almost uniform thickness, the prediction of the dimensional change due to the relaxation of the warp and the sink after the molding can be facilitated.

EXAMPLE 1

Examples of the present invention will be explained particularly, but the present invention is not limited to these Examples. In Example 1, the 100 ampere-frame circuit breaker will be explained hereunder. A concrete structure of this circuit breaker is as explained in the above embodiment. In the case of three pole product whose interpole pitch is 30 mm, the dimension of the base 1B in the width direction is 90 mm and the pressure between the contact points by the spring is less than 20 N.

Molding of the Crossbar in Sample Examples (11) to (41)

Figure 12:
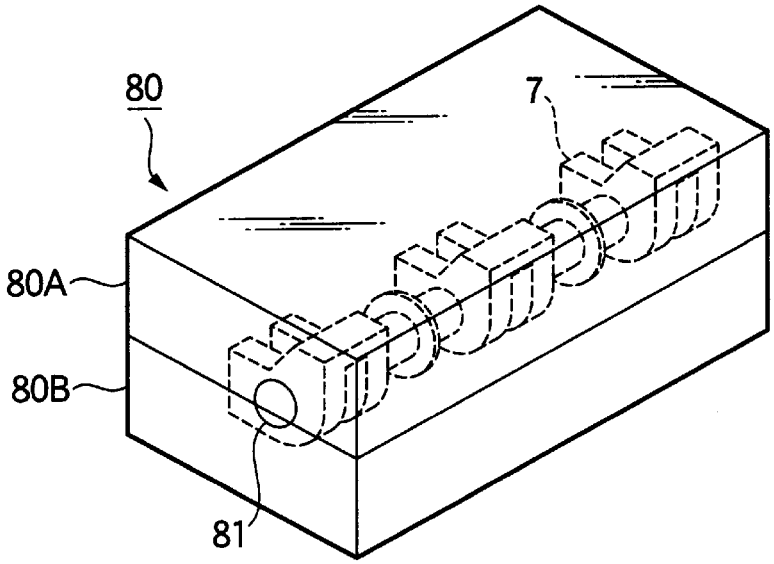
FIG. 12 is a view showing molds used to mold the 100 ampere-frame crossbar according to an Example 1 of the present invention.

FIG. 12 is a view showing molds used to mold the 100 ampere-frame crossbar according to an Example 1 of the present invention. In Figure, 80 denotes a mold which consists of an upper mold 80A and a lower mold 80B and whose inside shape is formed along the crossbar 7. 81 denotes a mixed material injection port that is formed by the upper mold 80A and the lower mold 80B. The crossbar 7 is molded by injecting the mixed material via the injection port 81 positioned at the end portion in the longitudinal direction of the mold 80 by virtue of the 75000 kg (75 ton) injection molding machine for the injection time of 9 to 11 seconds at the mold temperature of 174 to 176 degree, the cylinder front portion temperature of 80 to 85 degree, and the cylinder rear portion temperature of 60 to 70 degree. The molded crossbars 7 are subjected to the heat treatment under the conditions indicated in Table 1 to Table 4. In this manner, the crossbars 7 of sample examples (11) to (41) indicated in Table 1 to Table 4 were obtained. In the sample examples (11) to (41), the crossbars are formed of the phenol resin, the glass fiber (GF), and the filler, but the mixed rates and the heat treatment conditions are changed respectively.

The glass fiber means the fibrous substance made of the glass, and is not particularly limited if the total contained amount of the 1 A group metal compound in the periodic table is satisfied. As the glass material, E glass, S glass, D glass, T glass, silica glass, etc. may be listed. As normally known, it is preferable from the point of improvement of the impact resistant strength that the diameter of the glass fiber should be set to 6 to 13 $\mu$m and the aspect ratio should be set to more than 10.

As the inorganic filler, alumina, calcium carbonate, mica, clay, talc, kaolin, walastenite, etc. may be listed. As the organic filler, polyamide, polyester, polyacryl, etc. may be listed. As described above, the mixed rate of the organic filler is contained in the phenol resin based on its characteristic.

Molding of the Base in Sample Examples (11) to (41)

Figure 13:
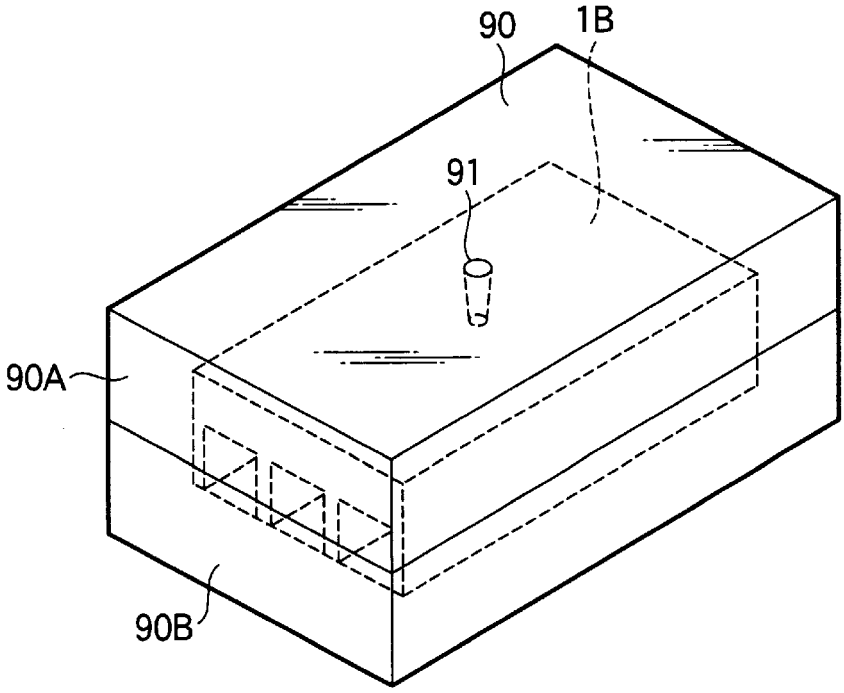
FIG. 13 is a view showing molds used to form the 100 ampere-frame base according to the Example 1 of the present invention.

FIG. 13 is a view showing molds used to form the 100 ampere-frame base according to the Example 1 of the present invention. In Figure, 90 denotes a mold which consists of a fixed mold 90A and a movable mold 90B and whose inside shape is formed along the base 1B. 91 denotes a mixed material injection port that is formed in the fixed mold 90A. The base 1B shown in FIG. 1, FIG. 2, FIG. 4 to FIG. 11 is molded by injecting the mixed material via the injection port 91 positioned in the center of the fixed mold 90A by virtue of the 160000 kg (160 ton) injection molding machine for a total time of the dwelling time and the injection time of 4 to 6 seconds at the movable mold temperature of 80 to 100 degree, the fixed mold temperature of 120 to 140 degree, and the cylinder temperature of 250 to 320 degree.

Then, the test method, the decision method, and test results will be explained hereunder.

Measurement of the Bending Modulus of Elasticity

The base 1B and the crossbar 7 shown in the sample examples (11) to (41) in Table 1 to Table 4 are measured in the atmosphere of 21° C. to 25° C. and 60% to 70% humidity, and then average values are employed as the bending moduli of elasticity Eb, Ec in the ordinary temperature and the ordinary humidity. Values are shown in Table 1 to Table 4.

In this case, since the change in the bending modulus of elasticity of polyamide (PA) due to the humidity is larger than other resins, such polyamide (PA) is also measured under the conditions of absolute dry (21° C. to 25° C., humidity relative 0%) for the sake of comparison. The bending modulus of elasticity in the absolute dry is 7500 MPa in the sample example (31) and is 10500 MPa in the sample examples (32), (33).

High-temperature/high-humidity Overtravel Test

In the structure of the circuit breaker shown in FIG. 2, when the circuit is closed, the stress applied to the crossbar 7 acts in the direction to reduce the overtravel. Normally a use term of the circuit breaker is 10 to 15 years. If the closed state is maintained continuously in the high-temperature/high-humidity state in Southeast Asia area, the inside of the tunnel, etc. during these years, a contact pressure between both contact points also disappear to damage the reliability of the current supply when the crossbar 7 and the base 1B, that are inferior in the overtravel performance, are employed. That is, this is because the creep deformation that is guessed as the main cause of the overtravel is not saturated as far as the stress is applied, and then finally the moldings comes up to the creep fracture. Therefore, the decision of the reduced amount of the overtravel between the base 1B and the crossbar 7 is made under following conditions.

After the circuit breaker (100 ampere-frame) is assembled by using the sample examples (11) to (41) as the base 1B and the crossbar 7 that are molded by the above method, the high-temperature/high-humidity over travel test was carried out. In the test, the assembled circuit breaker was held in the thermohygrostat bath at the temperature of 85° C. and the relative humidity of 85% for one week in the closed state, then the circuit breaker was closed and then left in the thermohygrostat bath at the temperature of 40° C. and the relative humidity of 85% for 3000 hours in this state, then the circuit breaker was taken out, and then the reduced amount of overtravel of the movable contact point 5 of each pole was measured. The reduced amount of overtravel after 15 years was estimated based on this measured results, i.e., measured results of the overtravel characteristic, and then it was decided based on the thickness of the contact point that the case where the reduced amount is below the reference value (1.2 mm in Example 1) is good.

Test Results

Results of the high-temperature/high-humidity overtravel test of polybutylene terephthalate (PBT), polyethylene terephthalate (PET), polyamide (PA), and polyphenylene sulfide (PPS) are shown in Table 1 to Table 4 respectively.

Because of the above-mentioned reason, the filler of the crossbar 7 in Table 1 to Table 4 signifies the inorganic filler and also the organic filler is contained in the resin and shown in Table 1 to Table 4.

Polybutylene Terephthalate (PBT)

In the sample examples (11) to (15), the base 1B is formed of polybutyleneterephthalate (PBT) to which the flame retardant is added and the glass fiber (GF). The sample example (13) having the small sum (Eb+Ec) of the bending moduli of elasticity and the sample examples (13), (14) having the small bending modulus of elasticity Eb respectively failed to stand the high-temperature/high-humidity overtravel test.

The flame retardant is the halogen compound (dibromopolyethylene and bromine epoxy), for example, and its weight percent is 25 to 40 to polybutylene terephthalate (PBT) 100.

Also, the sample examples (11), (12), (15) are excellent in the impact resistance strength, and the crack hardly occurs rather than the sample examples in Table 2 to Table 4 when the electric cable 25 is fitted to the terminal board 23 (FIG. 2) by the screws.

The base 1B is excellent in the overtravel characteristic when polybutylene terephthalate (PBT) containing the flame retardant is 55 to 70 wt % and the reinforcement is 30 to 45 wt %. At this time, the crossbar 7 containing the resin of 25 to 35 wt %, the reinforcement of 40 to 50 wt %, and the filler of 20 to 30 wt % is particularly preferable from the overtravel characteristic, or the crossbar 7 containing the resin of 55 to 65 wt %, the reinforcement of 10 to 25 wt %, and the filler of 10 to 25 wt % is particularly preferable from the point of good moldability.

The flame retardant is the halogen compound (dibromopolyethylene (dibromopolyethylene and bromine epoxy, etc.), for example, and its weight percent is 25 to 40 to polybutylene terephthalate (PBT) 100.

The sample examples (21), (25), (26), (28), (29) have the smaller reduction of overtravel than the sample example (22), further (21), (25), (28), (29) have the smaller reduction of overtravel than the sample example (26) and are good. In contrast, the sample examples (22), (26) are less affected by the orientation of the glass fibers than the sample examples (21), (25), (28), (29), and also are excellent in the point to suppress the distortion and the warp of the moldings.

Also, in the sample examples (21), (25), (26), (28), (29), the melting point of the moldings is higher than the samples in Table 1, and the base 1B is hard to melt in the overload durability test.

TABLE 1

| | Polybutylene Terephthalate (PBT) | | | | | |
|---|---|---|---|---|---|---|
| | base | | Crossbar | | | overtravel |
| sample | material (wt %) | ABME (MPa) | material (wt %) | Heat treatment conditions | ABME (MPa) | test result |
| 11 | PBT: 68 to 72<br>+flame retardant<br>GF: 28 to 32 | 8000 | resin: 88 to 92<br>GF: 8 to 12<br>filler: 0 | 150° C. 4 hrs<br>+180° C. 4 hrs | 9000 | OK |
| 12 | PBT: 68 to 72<br>+flame retardant<br>GF: 28 to 32 | 8000 | resin: 58 to 62<br>GF: 23 to 27<br>filler: 13 to 17 | +180° C. 8 hrs | 11500 | OK |
| 13 | PBT: 83 to 87<br>+flame retardant<br>GF: 13 to 17 | 5100 | resin: 58 to 62<br>GF: 23 to 27<br>filler: 13 to 17 | +180° C. 8 hrs | 11500 | NG |
| 14 | PBT: 83 to 87<br>+flame retardant<br>GF: 13 to 17 | 5100 | resin: 28 to 32<br>GF: 43 to 47<br>filler: 23 to 27 | 130° C. 2 hrs<br>+170° C. 8 hrs | 16000 | NG |
| 15 | PBT: 55 to 59<br>+flame retardant<br>GF: 41 to 45 | 11500 | resin: 88 to 92<br>GF: 8 to 12<br>filler: 0 | 150° C. 4 hrs<br>+180° C. 4 hrs | 9000 | OK |

ABME: average bending modulus of elasticity

Polyethylene Terephthalate (PET)

In the sample examples (21) to (29), the base 1B is formed of polyethylene terephthalate (PET) to which the flame retardant is added, and the glass fiber (GF). The sample examples (23), (24) having the small average bending modulus of elasticity Eb, and the sample example (27) having the small average bending modulus of elasticity Ec fail to stand the high-temperature/high-humidity overtravel test.

The base 1B was excellent in the overtravel characteristic when polyetylene terephthalate (PET) containing the flame retardant is 45 to 60 wt % and the reinforcement is 40 to 55 wt %. At this time, the crossbar 7 containing the resin of 25 to 35 wt %, the reinforcement of 40 to 50 wt %, and the filler of 20 to 30 wt % is particularly preferable from the overtravel characteristic, or the crossbar 7 containing the resin of 55 to 65 wt %, the reinforcement of 10 to 25 wt %, and the filler of 10 to 25 wt % is particularly preferable from the point of good moldability.

TABLE 2

| | Polyethylene Terephthalate (PET) | | | | | |
|---|---|---|---|---|---|---|
| | base | | crossbar | heat treatment | | overtravel |
| sample | material (wt %) | ABME (MPa) | material (wt %) | conditions | ABME (MPa) | test result |
| 21 | PET: 53 to 52<br>+flame retardant<br>GF: 43 to 47 | 15000 | resin: 58 to 62<br>GF: 23 to 27<br>Filler: 13 to 17 | 180° C. 8 hrs | 11500 | OK |

TABLE 2-continued

| Polyethylene Terephthalate (PET) | | | | | | |
|---|---|---|---|---|---|---|
| | base | | crossbar | | | |
| sample | material (wt %) | ABME (MPa) | material (wt %) | heat treatment conditions | ABME (MPa) | overtravel test result |
| 22 | PET: 73 to 77<br>+flame retardant<br>GF: 23 to 27 | 8500 | resin: 88 to 92<br>GF: 8 to 12<br>Filler: 0 | 150° C. 4 hrs<br>+180° C. 4 hrs | 9000 | OK |
| 23 | PET: 78 to 82<br>+flame retardant<br>GF: 18 to 22 | 7000 | resin: 58 to 62<br>GF: 23 to 27<br>Filler: 13 to 17 | 180° C. 8 hrs | 11500 | NG |
| 24 | PET: 78 to 82<br>+flame retardant<br>GF: 18 to 22 | 7000 | resin: 28 to 32<br>GF: 43 to 47<br>Filler: 23 to 27 | 130° C. 2 hrs<br>+170° C. 8 hrs | 16000 | NG |
| 25 | PET: 53 to 57<br>+flame retardant<br>GF: 43 to 47 | 15000 | resin: 88 to 92<br>GF: 8 to 12<br>Filler: 0 | 150° C. 4 hrs<br>+180° C. 4 hrs | 9000 | OK |
| 26 | PET: 68 to 72<br>+flame retardant<br>GF: 28 to 32 | 10000 | Resin: 88 to 92<br>GF: 8 to 12<br>Filler: 0 | 150° C. 4 hrs<br>+180° C. 4 hrs | 9000 | OK |
| 27 | PET: 68 to 72<br>+flame retardant<br>GF: 28 to 32 | 10000 | Resin: 90 to 94<br>GF: 6 to 10<br>Filler: 0 | 150° C. 4 hrs<br>+180° C. 4 hrs | 8000 | NG |
| 28 | PET: 43 to 47<br>+flame retardant<br>GF: 53 to 57 | 17000 | Resin: 88 to 92<br>GF: 8 to 12<br>Filler: 0 | 150° C. 4 hrs<br>+180° C. 4 hrs | 9000 | OK |
| 29 | PET: 43 to 47<br>+flame retardant<br>GF: 53 to 57 | 17000 | Resin: 58 to 62<br>GF: 23 to 27<br>filler: 13 to 17 | 180° C. 8 hrs | 11500 | OK |

ABME: average bending modulus of elasticity

Polyamide (PA)

In the sample example (31), the base 1B is formed of polyamide (PA), the glass fiber (GF), and magnesium hydroxide, and corresponds to that disclosed in Patent Application Publication (KOKAI) Hei 8-171847. This sample example (31) fails to stand the overtravel test. Also, the sample example (32) fails to stand the overtravel test, and also the sample example (33) fails to stand the overtravel test.

The flame retardant is the halogen compound (dibromopolyethylene and bromine epoxy, etc.), for example, and elastomer is ionomer as polyolefin copolymer or ethylene/propylene copolymer. The weight percents of the flame retardant and the elastomer are 50 to 70 and 20 to 30 to polyamide (PA) 100.

Also, the sample example (33) is excellent in the impact resistance and the insulating characteristic after the arc between the contact points is shut off in addition to the overtravel characteristic, and is preferable as the base 1B of the circuit breaker. In this case, the sample in which the elastomer is not added to the polyamide of the base 1B of the sample example (33) is inferior in the impact resistance to the sample example (33), but is superior in the overtravel characteristic.

In addition, the polyamide (PA) has the relatively large change of the bending modulus of elasticity due to the humidity. There is such a tendency that an amount of overtravel becomes larger than other thermoplastic resin that has the same bending modulus of elasticity at the ordinary temperature/the ordinary humidity.

TABLE 3

| Polyamide (PA) | | | | | | |
|---|---|---|---|---|---|---|
| | base | | Crossbar | | | |
| sample | material (wt %) | ABME (MPa) | material (wt %) | heat treatment conditions | ABME (MPa) | overtravel test result |
| 31 | PA: 48 to 52<br>GF: 18 to 22<br>$Mg(OH)_2$: 28 to 32 | 6800 | resin: 28 to 32<br>GF: 43 to 47<br>filler: 23 to 27 | 130° C. 2 hrs<br>+170° C. 8 hrs | 16000 | NG |
| 32 | PA: 56 to 60<br>+flame retardant<br>+elastomer<br>GF: 40 to 44 | 8400 | resin: 90 to 94<br>GF: 6 to 10<br>filler: 0 | 150° C. 4 hrs<br>+180° C. 4 hrs | 8000 | NG |

TABLE 3-continued

| | Polyamide (PA) | | | | | |
|---|---|---|---|---|---|---|
| | | | Crossbar | | | |
| sam- | base | | | heat treatment | | overtravel |
| ple | material (wt %) | ABME (MPa) | material (wt %) | conditions | ABME (MPa) | test result |
| 33 | PBT: 56 to 60<br>+flame retardant<br>+elastomer<br>GF: 40 to 44 | 8400 | resin: 28 to 32<br>GF: 43 to 47<br>filler: 23 to 27 | 130° C. 2 hrs<br>+170° C. 8 hrs | 16000 | OK |

ABME: average bending modulus of elasticity

Polyphenylene Sulfide (PPS)

In the sample example (41), the base 1B is formed of polyphenylene sulfide (PPS) to which the filler is added, and the glass fiber (GF). The sample example (41) failed to stand the high-temperature/high-humidity overtravel test.

The filler which is added to the polyphenylene sulfide (PPS) is calcium carbonate as the inorganic filler, and its weight percent is 70 to 80 to the polyphenylene sulfide (PPS) 100, for example.

The sample example (41) has the small molding distortion and has the higher melting point of the moldings than the samples in Table 1, Table 2.

TABLE 4

| | Polyphenylene sulfide (PPS) | | | | | |
|---|---|---|---|---|---|---|
| | | | Crossbar | | | |
| | base | | | heat treatment | | overtravel |
| sample | material (wt %) | ABME (MPa) | material (wt %) | conditions | ABME (MPa) | test results |
| 41 | PPS: 33 to 37<br>GF: 63 to 67<br>+filler | 21000 | resin: 58 to 62<br>GF: 23 to 27<br>filler: 13 to 17 | 180° C. 8 hrs | 11500 | OK |

ABME: average bending modulus of elasticity

As described above, in the case of the sample examples (11), (12), (15), (21), (22), (25), (26), (28), (29), (33), (41), i.e., in the case of Eb+Ec≧17000 MPa, 8000 MPa≦Eb, and 9000 MPa≦Ec, they were able to stand the high-temperature/high-humidity overtravel test.

Also, in the case of the sample examples (15), (21), (25), (28), (29), (41), i.e., in the case of Eb+Ec≧20500 MPa, 9000 MPa≦Eb, and 9000 MPa≦Ec, the good high-temperature/high-humidity overtravel characteristic was obtained.

In addition, in the case of the sample examples (21), (29), (41), i.e., in the case of Eb+Ec≧25000 MPa, 9000 MPa≦Eb≦22000 MPa, and 9000 MPa≦Ec≦17000 MPa, the very good high-temperature/high-humidity overtravel characteristic was obtained.

Further, it was found that, if a principal component of the moldings shown in Table 3 is the polyamide (PA), the dimensional change due to the warp, the sink, and the moisture absorption of the moldings act to promote the reduction of overtravel due to the creep deformation. As a result, the polybutylene terephthalate (PBT), the polyethylene terephthalate (PET), or the polyphenylene sulfide (PPS) shown in Tables 1, 2, 4 is more preferable as a principal component of the moldings from the overtravel characteristic.

Moreover, the polybutylene terephthalate (PBT) or the polyethylene terephthalate (PET) is preferable from the viewpoints that can satisfy the requests such as the miniaturization, the lightweight, no generation of the waste in the molding, the heat resistance, the mechanical strength, the impact resistance, the outer appearance, the flame retardance, the insulation resistance after the arc is shut off, the tracking, the cost, etc. required for the base 1B of the circuit breaker with good balance.

Industrial Applicability

The circuit breaker according to the present invention can be used as the master circuit breaker for the switchboard or the distribution board and the control board.

What is claimed is:

1. A circuit breaker comprising:

fixed contacts each having a fixed contact point;

movable contacts each having a movable contact point that is connected/disconnected to/from the fixed contact point;

a spring for applying a pushing force to both contact points when both contact points come into contact with each other;

a crossbar formed integrally of insulating resin as a principal component to hold the movable contact swingably, and coupled to a lower link of a toggle link mechanism to swing around its swing axis with a motion of the toggle link mechanism;

a switching mechanism portion for releasing an accumulated energy of a spring of the toggle link mechanism in response to a handle operation to execute quick-make and quick-break of the movable contact; and a molded case constructed by a base that fixes/supports the switching mechanism portion and a cover covered on the base from a handle side;

wherein the base is a moldings that contains thermoplastic resin as a principal component to have a bending modulus of elasticity Eb at an ordinary temperature/ ordinary humidity, and the crossbar is a moldings that has a bending modulus of elasticity Ec at an ordinary temperature/ordinary humidity, and following relationships are satisfied $$Eb+Ec \geqq 17000 \text{ MPa} \quad (1)$$

$$8000 \text{ MPa} \leqq Eb \quad (2)$$

$$9000 \text{ MPa} \leqq Ec \quad (3).$$

2. A circuit breaker according to claim 1, wherein the bending moduli of elasticity Eb, Ec satisfy following relationships $$Eb+Ec \geqq 205000 \text{ MPa} \quad (4)$$

$$9000 \text{ MPa} \leqq Eb \quad (5)$$

$$9000 \text{ MPa} \leqq Ec \quad (6).$$

3. A circuit breaker according to claim 2, wherein the bending moduli of elasticity Eb, Ec satisfy following relationships $$Eb+Ec \geqq 25000 \text{ MPa} \quad (7)$$

$$9000 \text{ MPa} \leqq Eb \leqq 22000 \text{ MPa} \quad (8)$$

$$9000 \text{ MPa} \leqq Ec \leqq 17000 \text{ MPa} \quad (9).$$

4. A circuit breaker according to claim 1, wherein the thermoplastic resin is at least any one of polybutylene terephthalate, polyethylene terephthalate, polyamide, aliphatic polyketone, polyphenylene sulfide, and their alloy material.

5. A circuit breaker according to claim 4, wherein the polyamide is at least any one of nylon 66, nylon MXD6, nylon 46, and nylon 6T.

6. A circuit breaker according to claim 4, wherein the thermoplastic resin is at least any one of polyethylene terephthalate, polyphenylene sulfide, and their alloy material.

7. A circuit breaker according to claim 1, wherein the base contains polybutylene terephthalate of 55 to 70 wt % to which a flame retardant is added, and reinforcement of 30 to 45 wt %.

8. A circuit breaker according to claim 1, wherein the base contains polyethylene terephthalate of 40 to 70 wt % to which a flame retardant is added, and reinforcement of 30 to 60 wt %.

9. A circuit breaker according to claim 1, wherein the base contains polyamide of 56 to 60 wt % to which a flame retardant and elastomer are added, and reinforcement of 40 to 44 wt %.

10. A circuit breaker according to claim 1, wherein the crossbar contains phenol resin as a principal component.

11. A circuit breaker according to claim 1, wherein the circuit breaker is a multipolar type, and has slits in walls, that orthogonally intersect with a bottom wall of the base, to extend in its wall direction.

12. A circuit breaker according to claim 11, wherein the slits divide an orthogonal wall to have a uniform thickness.

13. A circuit breaker according to claim 11, wherein the slits are provided alternatively from front and back surface sides of the base.

14. A circuit breaker according to claim 11, wherein the orthogonally intersecting walls are interphase walls.

15. A circuit breaker according to claim 11, wherein a base thickness between the slits is equal to that of a base bottom wall.

16. A circuit breaker according to claim 11, wherein the orthogonally intersecting walls are a wall provided between a contact point housing portion for housing the movable contact point and the fixed contact point and a switching mechanism housing portion for housing a switching mechanism portion.

17. A circuit breaker according to claim 16, wherein the slits are formed to be opened on a back surface side of the base.

18. A circuit breaker according to claim 17, wherein thicknesses of walls between the slits and an inside of the base are formed thinner than a thickness of the base bottom wall.

19. A circuit breaker comprising:

fixed contacts each having a fixed contact point;

movable contacts each having a movable contact point that is connected/disconnected to/from the fixed contact point;

a spring for applying a pushing force to both contact points when both contact points come into contact with each other;

a crossbar formed integrally of insulating resin as a principal component to hold the movable contact swingably, and coupled to a lower link of a toggle link mechanism to swing around its swing axis with a motion of the toggle link mechanism;

a switching mechanism portion for releasing an accumulated energy of a spring of the toggle link mechanism in response to a handle operation to execute quick-make and quick-break of the movable contact; and a molded case constructed by a base that fixes/supports the switching mechanism portion and a cover covered on the base from a handle side;

wherein the base contains polyamide of 56 to 60 wt % to which a flame retardant and elastomer are added, and reinforcement of 40 to 44 wt %.

20. A circuit breaker according to claim 19, wherein the crossbar contains phenol resin of 28 to 32 wt %, reinforcement of 43 to 47 wt %, and inorganic filler of 23 to 27 wt %.

21. A circuit breaker according to claim 19, wherein the flame retardant and the elastomer are contained such that halogen compound has a weight percent of 50 to 70 and the elastomer has a weight percent of 20 to 30 to polyamide 100.

22. A circuit breaker comprising:

fixed contacts each having a fixed contact point;

movable contacts each having a movable contact point that is connected/disconnected to/from the fixed contact point;

a spring for applying a pushing force to both contact points when both contact points come into contact with each other;

a crossbar formed integrally of insulating resin as a principal component to hold the movable contact swingably, and coupled to a lower link of a toggle link mechanism to swing around its swing axis with a motion of the toggle link mechanism;

a switching mechanism portion for releasing an accumulated energy of a spring of the toggle link mechanism in response to a handle operation to execute quick-make and quick-break of the movable contact; and a molded case constructed by a base that fixes/supports the switching mechanism portion and a cover covered on the base from a handle side;

wherein the base contains polyethylene terephthalate of 45 to 60 wt % to which a flame retardant is added, and reinforcement of 40 to 55 wt %.

23. A circuit breaker according to claim 22, wherein the crossbar contains phenol resin of 55 to 65 wt %, reinforcement of 10 to 25 wt %, and inorganic filler of 10 to 25 wt %.

24. A circuit breaker according to claim 22, wherein the crossbar contains phenol resin of 25 to 35 wt %, reinforcement of 40 to 50 wt %, and inorganic filler of 20 to 30 wt %.

25. A circuit breaker according to claim 22, wherein the flame retardant is contained such that halogen compound has a weight percent of 25 to 40 to polyethylene terephthalate 100.

26. A circuit breaker comprising:

fixed contacts each having a fixed contact point;

movable contacts each having a movable contact point that is connected/disconnected to/from the fixed contact point;

a spring for applying a pushing force to both contact points when both contact points come into contact with each other;

a crossbar formed integrally of insulating resin as a principal component to hold the movable contact swingably, and coupled to a lower link of a toggle link mechanism to swing around its swing axis with a motion of the toggle link mechanism;

a switching mechanism portion for releasing an accumulated energy of a spring of the toggle link mechanism in response to a handle operation to execute quick-make and quick-break of the movable contact; and a molded case constructed by a base that fixes/supports the switching mechanism portion and a cover covered on the base from a handle side;

wherein the base contains polyethylene terephthalate of 40 to 70 wt % to which a flame retardant is added, and reinforcement of 30 to 60 wt %, and the crossbar contains phenol resin of 25 to 35 wt %, reinforcement of 40 to 50 wt %, and inorganic filler of 20 to 30 wt %.

27. A circuit breaker comprising:

fixed contacts each having a fixed contact point;

movable contacts each having a movable contact point that is connected/disconnected to/from the fixed contact point;

a spring for applying a pushing force to both contact points when both contact points come into contact with each other;

a crossbar formed integrally of insulating resin as a principal component to hold the movable contact swingably, and coupled to a lower link of a toggle link mechanism to swing around its swing axis with a motion of the toggle link mechanism;

a switching mechanism portion for releasing an accumulated energy of a spring of the toggle link mechanism in response to a handle operation to execute quick-make and quick-break of the movable contact; and a molded case constructed by a base that fixes/supports the switching mechanism portion and a cover covered on the base from a handle side;

wherein the base contains polyethylene terephthalate of 40 to 70 wt % to which a flame retardant is added, and reinforcement of 30 to 60 wt %, and the crossbar contains phenol resin of 55 to 65 wt %, reinforcement of 10 to 25 wt %, and inorganic filler of 10 to 25 wt %.

28. A circuit breaker comprising:

fixed contacts each having a fixed contact point;

movable contacts each having a movable contact point that is connected/disconnected to/from the fixed contact point;

a spring for applying a pushing force to both contact points when both contact points come into contact with each other;

a crossbar formed integrally of insulating resin as a principal component to hold the movable contact swingably, and coupled to a lower link of a toggle link mechanism to swing around its swing axis with a motion of the toggle link mechanism;

a switching mechanism portion for releasing an accumulated energy of a spring of the toggle link mechanism in response to a handle operation to execute quick-make and quick-break of the movable contact; and a molded case constructed by a base that fixes/supports the switching mechanism portion and a cover covered on the base from a handle side;

wherein the base contains polyethylene terephthalate of 55 to 70 wt % to which a flame retardant is added, and reinforcement of 30 to 45 wt %.

29. A circuit breaker according to claim 28, wherein the crossbar contains phenol resin of 25 to 35 wt %, reinforcement of 40 to 50 wt %, and inorganic filler of 20 to 30 wt %.

30. A circuit breaker according to claim 28, wherein the crossbar contains phenol resin of 55 to 65 wt %, reinforcement of 10 to 25 wt %, and inorganic filler of 10 to 25 wt %.

31. A circuit breaker according to claim 28, wherein the flame retardant is contained such that halogen compound has a weight percent of 25 to 40 to polyethylene terephthalate 100.

32. A circuit breaker comprising:

fixed contacts each having a fixed contact point;

movable contacts each having a movable contact point that is connected/disconnected to/from the fixed contact point;

a spring for applying a pushing force to both contact points when both contact points come into contact with each other;

a crossbar formed integrally of insulating resin as a principal component to hold the movable contact swingably, and coupled to a lower link of a toggle link mechanism to swing around its swing axis with a motion of the toggle link mechanism;

a switching mechanism portion for releasing an accumulated energy of a spring of the toggle link mechanism in response to a handle operation to execute quick-make and quick-break of the movable contact; and a molded case constructed by a base that fixes/supports the switching mechanism portion and a cover covered on the base from a handle side;

wherein main resin of the base is formed of thermoplastic resin, and slits are provided in walls, that orthogonally intersect with a bottom wall of the base, to extend in its wall direction.

33. A circuit breaker according to claim 32, wherein the slits divide an orthogonal wall to have a uniform thickness.

34. A circuit breaker according to claim 32, wherein the slits are provided alternatively from front and back surface sides of the base.

35. A circuit breaker according to claim 32, wherein the orthogonally intersecting walls are interphase walls.

36. A circuit breaker according to claim 32, wherein a base thickness between the slits is equal to that of a base bottom wall.

37. A circuit breaker according to claim 32, wherein the orthogonally intersecting walls are a wall provided between a contact point housing portion for housing the movable contact point and the fixed contact point and a switching mechanism housing portion for housing a switching mechanism portion.

38. A circuit breaker according to claim 37, wherein the slits are formed to be opened on a back surface side of the base.

39. A circuit breaker according to claim 37, wherein thicknesses of walls between the slits and an inside of the base are formed thinner than a thickness of the base bottom wall.

* * * * *

UNITED STATES PATENT AND TRADEMARK OFFICE

CERTIFICATE OF CORRECTION

PATENT NO. : 6,570,481 B2 
DATED : May 27, 2003
INVENTOR(S) : Shunichi Katsube and Kazunori Fukuya It is certified that error appears in the above-identified patent and that said Letters Patent is hereby corrected as shown below:

Column 23,
Line 15, delete "Eb+Ec≥205,000 MPa …(4) and insert
-- Eb+Ec≧20500 MPa …(4) --

Column 26,
Line 16, delete "polyethylene terephthalate" and insert -- polybutylene terephthalate --
Line 29, delete "polyethylene terephthalate" and insert -- polybutylene terephthalate --

Signed and Sealed this

Twenty-eighth Day of October, 2003

JAMES E. ROGAN
*Director of the United States Patent and Trademark Office*